United States Patent [19]

Watanabe

[11] Patent Number: 4,769,675

[45] Date of Patent: Sep. 6, 1988

[54] IMAGE FORMING APPARATUS WITH IMAGE ADDING FUNCTION

[75] Inventor: Junji Watanabe, Yokohama, Japan

[73] Assignee: Kabushiki Kaisha Toshiba, Kawasaki, Japan

[21] Appl. No.: 913,350

[22] Filed: Sep. 30, 1986

Related U.S. Application Data

[62] Division of Ser. No. 838,336, Mar. 10, 1986.

[30] Foreign Application Priority Data

| | | | |
|---|---|---|---|
| Mar. 18, 1985 | [JP] | Japan | 60-53737 |
| Mar. 20, 1985 | [JP] | Japan | 60-56533 |
| Apr. 15, 1985 | [JP] | Japan | 60-79960 |
| Apr. 15, 1985 | [JP] | Japan | 60-79961 |
| May 29, 1985 | [JP] | Japan | 60-115938 |

[51] Int. Cl.[4] ..... G03G 15/01; G03G 21/00

[52] U.S. Cl. ..... 355/14 R; 346/157; 355/4; 355/7

[58] Field of Search ..... 355/3 R, 4, 7, 14 R, 355/14 C; 346/157, 160

[56] References Cited

U.S. PATENT DOCUMENTS

| | | | |
|---|---|---|---|
| 3,960,445 | 6/1976 | Drawe | 355/4 |
| 4,640,601 | 2/1987 | Deguchi et al. | 355/3 R |
| 4,655,580 | 4/1987 | Watanabe et al. | 355/7 |

*Primary Examiner*—Fred L. Braun

*Attorney, Agent, or Firm*—Foley & Lardner, Schwartz, Jeffery, Schwaab, Mack, Blumenthal & Evans

[57] ABSTRACT

An image forming apparatus with an image adding function for modifying an original image in the same or different colors to include, for example, underlining bar-graphs, characters and symbols. The image forming apparatus includes a light-transmitting unit that moves along an original table in order to specify the desired portion of the original image to be modified. Positional data generated by the operation of the light-transmitting unit is supplied to an image-erasing unit and an image-forming unit which are controlled by a processor in order to perform the image adding function. A color other than black is designated as a first image forming color and black is designated as a second image forming color, such that light can be easily transmitted through the first image forming color in the regions where the first and second image forming colors are to be superposed.

12 Claims, 47 Drawing Sheets

FIG. 11
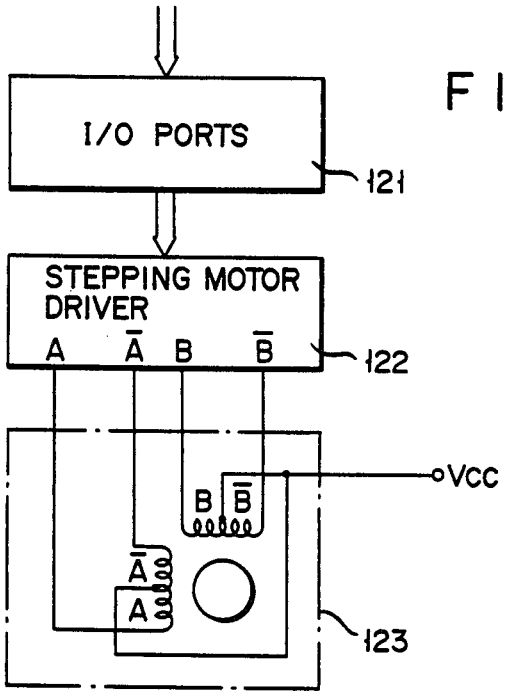
FIG. 12A
FIG. 12B
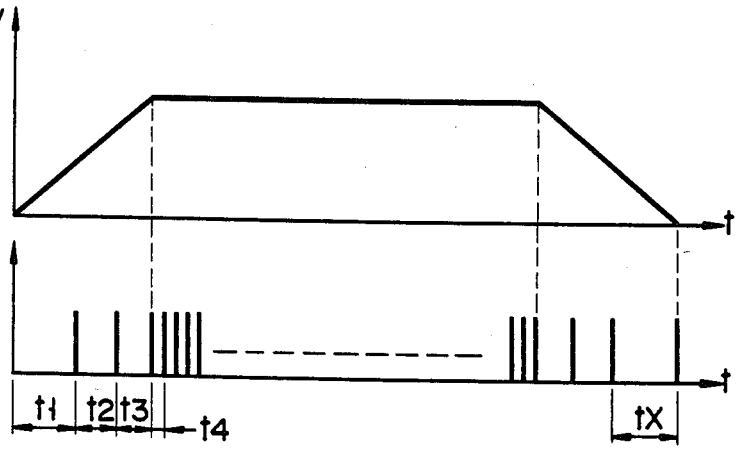

FIG. 31

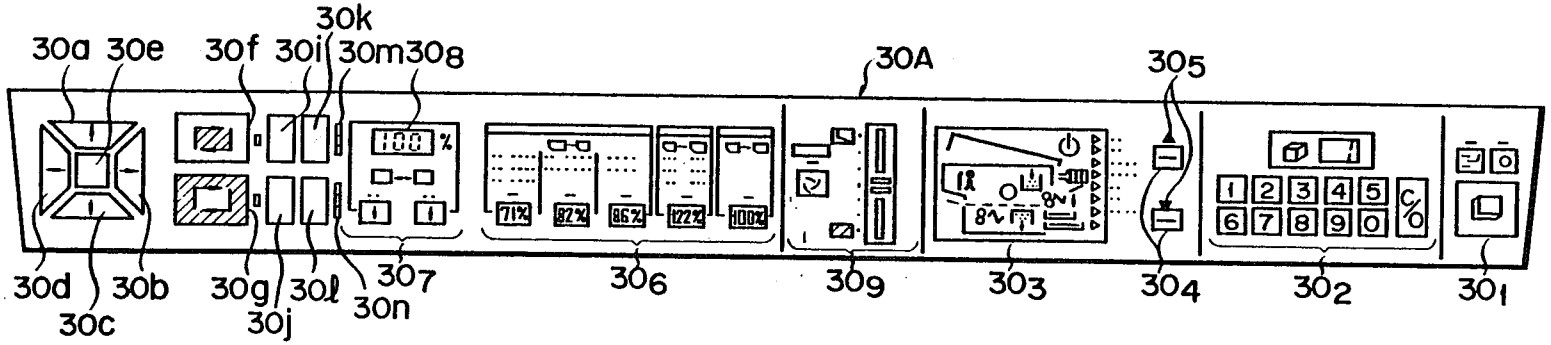
30a
30e
30d
30b
30c
30f
30i
30k
30m
30g
30j
30l
30n
30o
30A
30p
30q
30r
30s
30t
30u
30v
30w
30x
30y
30z
30aa
30ab
30ac
30ad
30ae
30af
30ag
30ah
30ai
30aj
30ak
30al
30am
30an
30ao
30ap
30aq
30ar
30as
30at
30au
30av
30aw
30ax
30ay
30az
30ba
30bb
30bc
30bd
30be
30bf
30bg
30bh
30bi
30bj
30bk
30bl
30bm
30bn
30bo
30bp
30bq
30br
30bs
30bt
30bu
30bv
30bw
30bx
30by
30bz
30ca
30cb
30cc
30cd
30ce
30cf
30cg
30ch
30ci
30cj
30ck
30cl
30cm
30cn
30co
30cp
30cq
30cr
30cs
30ct
30cu
30cv
30cw
30cx
30cy
30cz
30da
30db
30dc
30dd
30de
30df
30dg
30dh
30di
30dj
30dk
30dl
30dm
30dn
30do
30dp
30dq
30dr
30ds
30dt
30du
30dv
30dw
30dx
30dy
30dz
30ea
30eb
30ec
30ed
30ee
30ef
30eg
30eh
30ei
30ej
30ek
30el
30em
30en
30eo
30ep
30eq
30er
30es
30et
30eu
30ev
30ew
30ex
30ey
30ez
30fa
30fb
30fc
30fd
30fe
30ff
30fg
30fh
30fi
30fj
30fk
30fl
30fm
30fn
30fo
30fp
30fq
30fr
30fs
30ft
30fu
30fv
30fw
30fx
30fy
30fz
30ga
30gb
30gc
30gd
30ge
30gf
30gg
30gh
30gi
30gj
30gk
30gl
30gm
30gn
30go
30gp
30gq
30gr
30gs
30gt
30gu
30gv
30gw
30gx
30gy
30gz
30ha
30hb
30hc
30hd
30he
30hf
30hg
30hh
30hi
30hj
30hk
30hl
30hm
30hn
30ho
30hp
30hq
30hr
30hs
30ht
30hu
30hv
30hw
30hx
30hy
30hz
30ia
30ib
30ic
30id
30ie
30if
30ig
30ih
30ii
30ij
30ik
30il
30im
30in
30io
30ip
30iq
30ir
30is
30it
30iu
30iv
30iw
30ix
30iy
30iz
30ja
30jb
30jc
30jd
30je
30jf
30jg
30jh
30ji
30jj
30jk
30jl
30jm
30jn
30jo
30jp
30jq
30jr
30js
30jt
30ju
30jv
30jw
30jx
30jy
30jz
30ka
30kb
30kc
30kd
30ke
30kf
30kg
30kh
30ki
30kj
30kk
30kl
30km
30kn
30ko
30kp
30kq
30kr
30ks
30kt
30ku
30kv
30kw
30kx
30ky
30kz
30la
30lb
30lc
30ld
30le
30lf
30lg
30lh
30li
30lj
30lk
30ll
30lm
30ln
30lo
30lp
30lq
30lr
30ls
30lt
30lu
30lv
30lw
30lx
30ly
30lz
30ma
30mb
30mc
30md
30me
30mf
30mg
30mh
30mi
30mj
30mk
30ml
30mm
30mn
30mo
30mp
30mq
30mr
30ms
30mt
30mu
30mv
30mw
30mx
30my
30mz
30na
30nb
30nc
30nd
30ne
30nf
30ng
30nh
30ni
30nj
30nk
30nl
30nm
30nn
30no
30np
30nq
30nr
30ns
30nt
30nu
30nv
30nw
30nx
30ny
30nz
30oa
30ob
30oc
30od
30oe
30of
30og
30oh
30oi
30oj
30ok
30ol
30om
30on
30oo
30op
30oq
30or
30os
30ot
30ou
30ov
30ow
30ox
30oy
30oz
30pa
30pb
30pc
30pd
30pe
30pf
30pg
30ph
30pi
30pj
30pk
30pl
30pm
30pn
30po
30pp
30pq
30pr
30ps
30pt
30pu
30pv
30pw
30px
30py
30pz
30qa
30qb
30qc
30qd
30qe
30qf
30qg
30qh
30qi
30qj
30qk
30ql
30qm
30qn
30qo
30qp
30qq
30qr
30qs
30qt
30qu
30qv
30qw
30qx
30qy
30qz
30ra
30rb
30rc
30rd
30re
30rf
30rg
30rh
30ri
30rj
30rk
30rl
30rm
30rn
30ro
30rp
30rq
30rr
30rs
30rt
30ru
30rv
30rw
30rx
30ry
30rz
30sa
30sb
30sc
30sd
30se
30sf
30sg
30sh
30si
30sj
30sk
30sl
30sm
30sn
30so
30sp
30sq
30sr
30ss
30st
30su
30sv
30sw
30sx
30sy
30sz
30ta
30tb
30tc
30td
30te
30tf
30tg
30th
30ti
30tj
30tk
30tl
30tm
30tn
30to
30tp
30tq
30tr
30ts
30tt
30tu
30tv
30tw
30tx
30ty
30tz
30ua
30ub
30uc
30ud
30ue
30uf
30ug
30uh
30ui
30uj
30uk
30ul
30um
30un
30uo
30up
30uq
30ur
30us
30ut
30uu
30uv
30uw
30ux
30uy
30uz
30va
30vb
30vc
30vd
30ve
30vf
30vg
30vh
30vi
30vj
30vk
30vl
30vm
30vn
30vo
30vp
30vq
30vr
30vs
30vt
30vu
30vv
30vw
30vx
30vy
30vz
30wa
30wb
30wc
30wd
30we
30wf
30wg
30wh
30wi
30wj
30wk
30wl
30wm
30wn
30wo
30wp
30wq
30wr
30ws
30wt
30wu
30wv
30ww
30wx
30wy
30wz
30xa
30xb
30xc
30xd
30xe
30xf
30xg
30xh
30xi
30xj
30xk
30xl
30xm
30xn
30xo
30xp
30xq
30xr
30xs
30xt
30xu
30xv
30xw
30xx
30xy
30xz
30ya
30yb
30yc
30yd
30ye
30yf
30yg
30yh
30yi
30yj
30yk
30yl
30ym
30yn
30yo
30yp
30yq
30yr
30ys
30yt
30yu
30yv
30yw
30yx
30yy
30yz
30za
30zb
30zc
30zd
30ze
30zf
30zg
30zh
30zi
30zj
30zk
30zl
30zm
30zn
30zo
30zp
30zq
30zr
30zs
30zt
30zu
30zv
30zw
30zx
30zy
30zz

IMAGE FORMING APPARATUS WITH IMAGE ADDING FUNCTION

This application is a division of application Ser. No. 838,336, filed Mar. 10, 1986.

BACKGROUND OF THE INVENTION

This invention relates to an image forming apparatus with an image adding function and, more particularly, to an image forming apparatus with an image adding function for forming an underline, a solid image of a predetermined width, or a predetermined character or symbol in a specific area of an original. The apparatus of the present invention is suitably adapted as an electrophotographic copying machine or the like.

In general, an electrophotographic copying machine has functions for reproducing original images without modifications or reproducing enlarged or reduced images of the original images.

Original images often contain unnecessary portions or portions to be reduced or enlarged. However, no conventional copying machine can partially erase an original image, enlarge, reduce, or underline an image portion, or add a solid image or a predetermined character or symbol image in the same or a different color to the remaining portion of the image.

SUMMARY OF THE INVENTION

It is, therefore, an object of the present invention to provide a new and improved image forming apparatus with an image adding function, which can selectively erase an unnecessary portion of an original image and which can form a line of a predetermined width on a desired image portion.

It is another object of the present invention to provide an image forming apparatus which can selectively erase an unnecessary portion of an original image and which can form an image containing a line of a predetermined width on a desired image portion, in a color different from the remaining image portion.

It is still another object of the present invention to provide an image forming apparatus which can selectively erase an unnecessary portion of an original image and which can form an image of a predetermined character or symbol on a desired image portion.

It is still another object of the present invention to provide an image forming apparatus which can underline a desired image portion using a multi-copy function, a function for designating a specified area of an original, and a function for erasing an image portion outside the specified area.

It is still another object of the present invention to provide an image forming apparatus which can form an image of a line of a specified width in a sepecified area of a desired image portion, in a color different from the remaining image portion, using a multi-copy function, a function for specifying a specified area of an original, and a function for erasing the charge (on a photosensitive drum of the apparatus) of the image portion outside the specified area and for forming an image in the specified area.

It is still another object of the present invention to provide an image forming apparatus which can form an image of a desired alphanumeric letter in a specified area of a desired image portion, using a multi-copy function, a function for designating a specified area, a function for erasing an image outside the specified area, and a function for generating a character or symbol pattern.

According to one aspect of the present invention, there is provided an image forming apparatus with an image adding function, the apparatus comprising:

an original table on which an original is placed, the original being capable of transmitting light therethrough;

light-transmitting means for emitting the light onto the original placed on the original table while the light is moved therealong;

line image forming range specifying means for designating a line image forming range by moving the light emitted by the light-transmitting means relative to a desired area on the original placed on the original table;

image forming color specifying means for specifying at least a preselected first image forming color other than black and a second image forming color of black in correspondence with formation of the first and second images;

first controlling means for calculating positional data of an image area outside the line image forming range specified by the line image forming range specifying means, based on movement of the light emitted by the light-transmitting means, and for storing the calculated positional data;

second controlling means for receiving and storing of the first and second image forming colors which are specified by the image forming color specifying means in correspondence with formation of the first and second images;

original scanning means, movable along the original table, for optically scanning the original placed on the original table and for forming a reflected light image thereof;

image forming means for focusing the reflected light image obtained by the original scanning means, developing the image, and forming a corresponding image on an image forming medium by selectively driving a plurality of developing units of different colors;

image forming medium feed-back means for selectively feeding back the image forming medium on which an image is formed by the image forming means;

image erasing means for selectively erasing the image formed by the image forming means third controlling means for enabling the image erasing means and the image forming means, an disabling the image forming medium feed-back means and the original scanning means during formation of the first image;

fourth controlling means, operable during formation of the second image, for reading out positional data of an image portion outside the line image forming range from the first controlling means and the data of the first image forming color from the second controlling means, and for supplying the readout data to the image erasing means, thereby allowing the image forming means to form a desired line image in the first image forming color in the specified line image forming range on the image forming medium;

fifth controlling means for disabling the image erasing means and enabling the image forming feedback means, the original scanning means, and the image forming means during formation of the second image; and sixth controlling means, operable during formation of the second image, for reading out the data of the second image forming color from the second controlling means and for supplying the readout data to the image forming means, thereby allowing the image forming means to form the image of the original in the second image forming color on the image forming medium, which has been fed back.

BRIEF DESCRIPTION OF THE DRAWINGS

These and other objects and features of the present invention can be understood through the following embodiment by reference to the accompanying drawings.

FIGS. 1 to 28A and 28B show a first embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram showing a general control circuit;

FIG. 8 is a functional block diagram of a main processor group;

FIG. 9 is a functional block diagram of a first sub-processor group;

FIG. 10 is a functional block diagram of a second sub-processor group;

FIG. 11 is a block diagram of a stepping motor control circuit;

FIGS. 12A and 12B are charts for explaining a method of controlling stepping motor speed;

FIG. 13 is a perspective view of the principal part including a spot light source;

FIG. 14 is a side sectional view of the principal part including the spot light source;

FIGS. 15, 16 and 17 are plan views illustrating an operation for specifying the erasure range of the original using the spot light source;

FIGS. 18 and 19 are plan views for explaining memory contents;

FIGS. 21 and 22 are a perspective view and a front view, respectively, of only the principal part of the erasure array, showing the relationship between the erasure array and a photosensitive drum;

FIG. 24 is a circuit diagram illustrating the configuration of an array drive section;

FIG. 26 is a flow chart of the underline control flow;

FIG. 27 is a front view of a main portion of a photosensitive drum for explaining underlining;

FIGS. 28A and 28B are, respectively, a side sectional view and a front view of the main portion shown in FIG. 27;

FIGS. 29 to 37A–37E show a second embodiment of an image forming apparatus according to the present invention, in which:

FIGS. 29 and 30 are a schematic perspective view and a side sectional view, respectively, showing the construction of the image forming apparatus;

FIG. 31 is a plan view of a control panel;

FIG. 32 is a perspective view showing an arrangement of drive sections;

FIG. 33 is a block diagram showing a general control circuit;

FIG. 35 is a flow chart of control flow for forming an additional line image and for forming an original image;

FIG. 36 is a diagram for explaining a main portion of a line forming section;

FIG. 37A is a diagram showing an example of a line image;

FIGS. 37B to 37E show examples of solid images;

FIG. 38 to 42 show a third embodiment of an image forming apparatus according to the present invention, in which:

FIG. 38 is a plan view of a control panel;

FIG. 39 is a block diagram showing a general control circuit;

FIG. 41 is a flow chart of control flow for forming an additional image;

FIG. 42 is a diagram for explaining formation of an additional image by an erasing array;

FIGS. 43 to 51A and 51B show different applications of an image forming apparatus according to the present invention, in which:

FIG. 43 is a plan view of a control panel;

FIG. 44 is a perspective view schematically showing a variable magnification lens drive mechanism;

FIG. 46 is a block diagram showing a general control circuit;

FIG. 47 is a plan view showing the principal part for explaining editing and copying;

FIGS. 49 and 50 are plan views showing the principal part for explaining different editing and copying operations; and FIGS. 51A and 51B are diagrams for explaining the erasing pitch.

DETAILED DESCRIPTION OF THE PREFERRED EMBODIMENTS

Preferred Embodiments of the present invention will be described with reference to the accompanying drawings.

Figure 1:
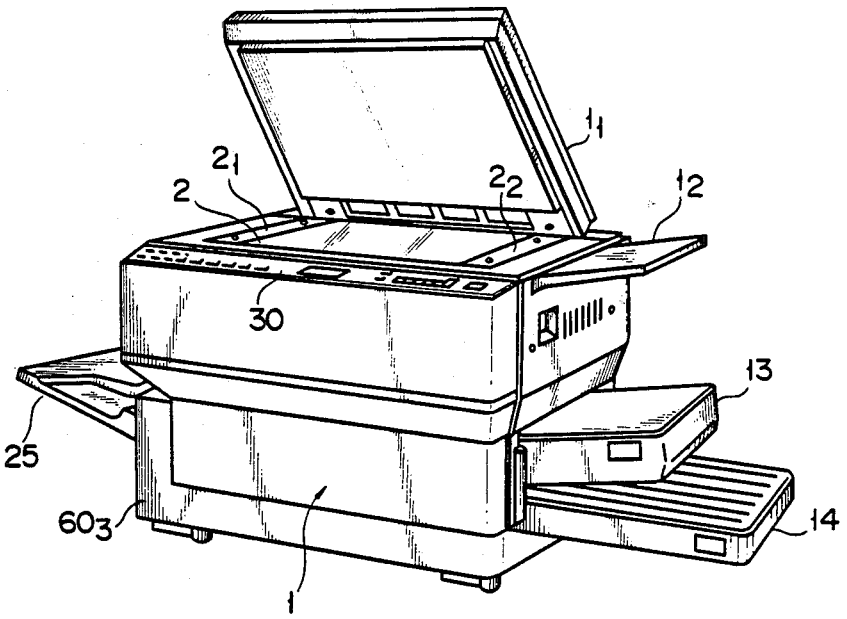
Figure 2:
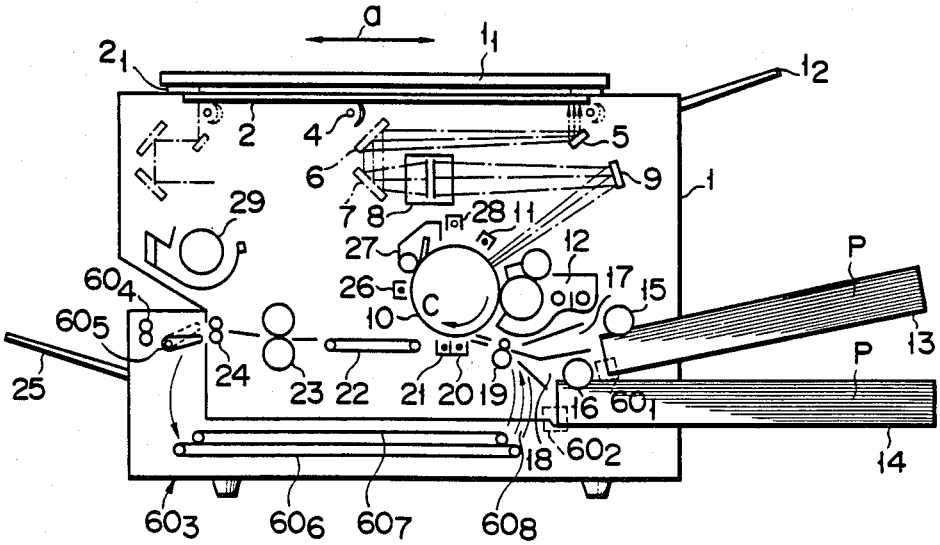

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. Fixed scales $2_1$, $2_2$ as references for setting an original are arranged at both end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow C so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner, Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches 601 and 602 which detect the selected cassette size. The detecting switches 601 and 602 are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and the transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Referring to FIG. 2, multicopying unit $60_3$ is arranged at the bottom of housing 1 and is used in the editing and copying mode. Unit $60_3$ feeds back the copied sheet to aligning roller pair 19 so as to form another image on the same sheet surface after the copied sheet is fed by discharge roller pair 24. Selection gate $60_5$ is arranged in unit $60_3$ between discharge roller pairs 24 and $60_4$. During copying, gate $60_5$ is set in the position indicated by the solid line in FIG. 2. However, in the editing/copying mode, gate $60_5$ is set in the position indicated by the broken line. The sheet fed out by roller pair 24 is thus guided between conveyor belts $60_6$ and $60_7$. Belts $60_6$ and $60_7$ convey the sheet while clamping it therebetween so that the sheet is guided along guide path $60_8$. The sheet guided along path $60_8$ is then fed to photosensitive drum 10 in synchronism with the optical system.

Figure 3:
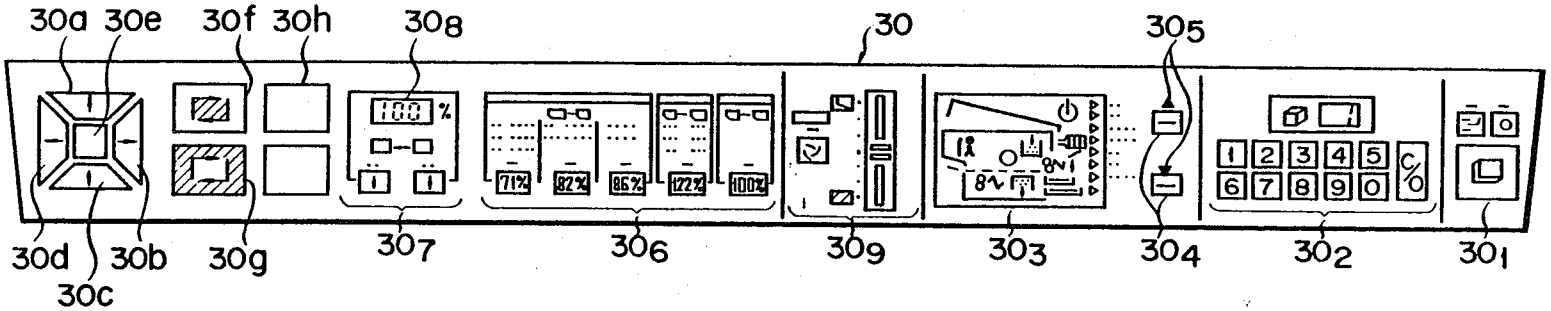

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts of paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unncessary portion of the original, a position designating key 30*e* for inputting the coordinate positions indicated by the spot light source, erasure range designating keys 30*f* and 30*g* for designating the erasure ranges in the designated positions, and 30*h*, an underline key for specifying underlining.

Figure 4:
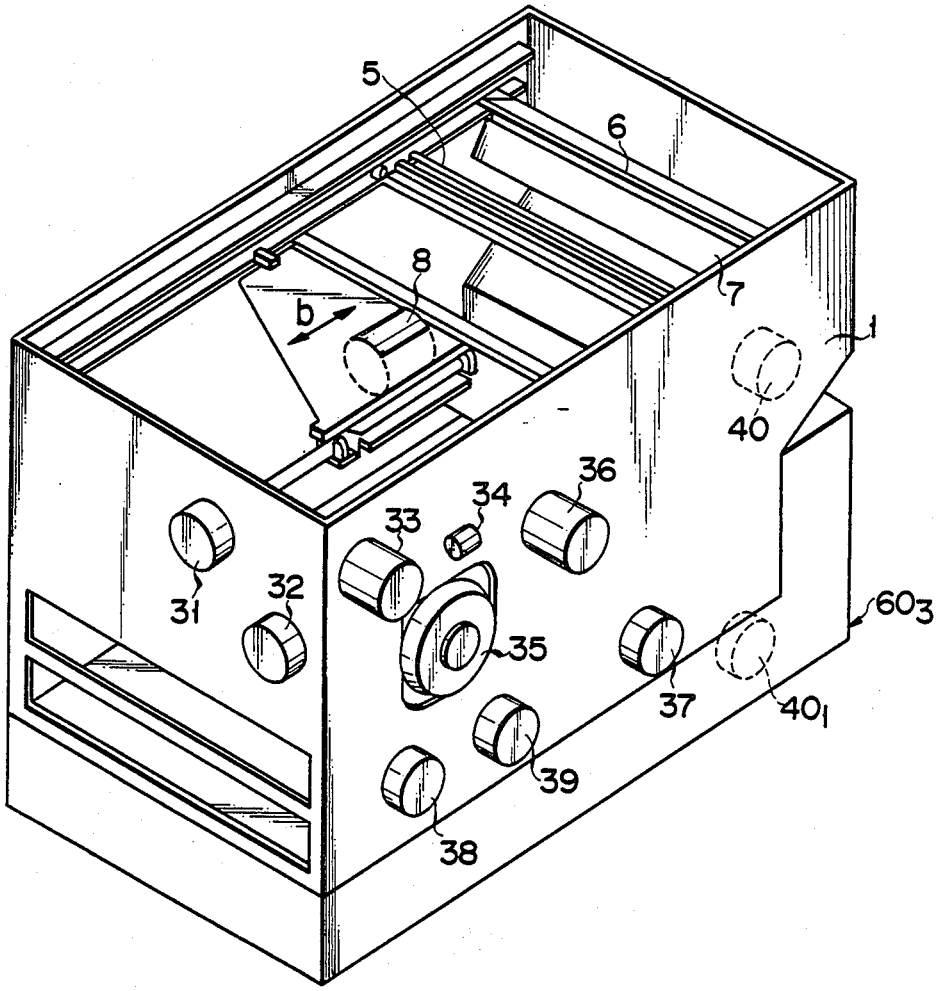

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper-supply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29. Numeral $40_1$ designates a motor. The motor $40_1$ serves to drive conveyor belts $60_6$, $60_7$.

Figure 5:
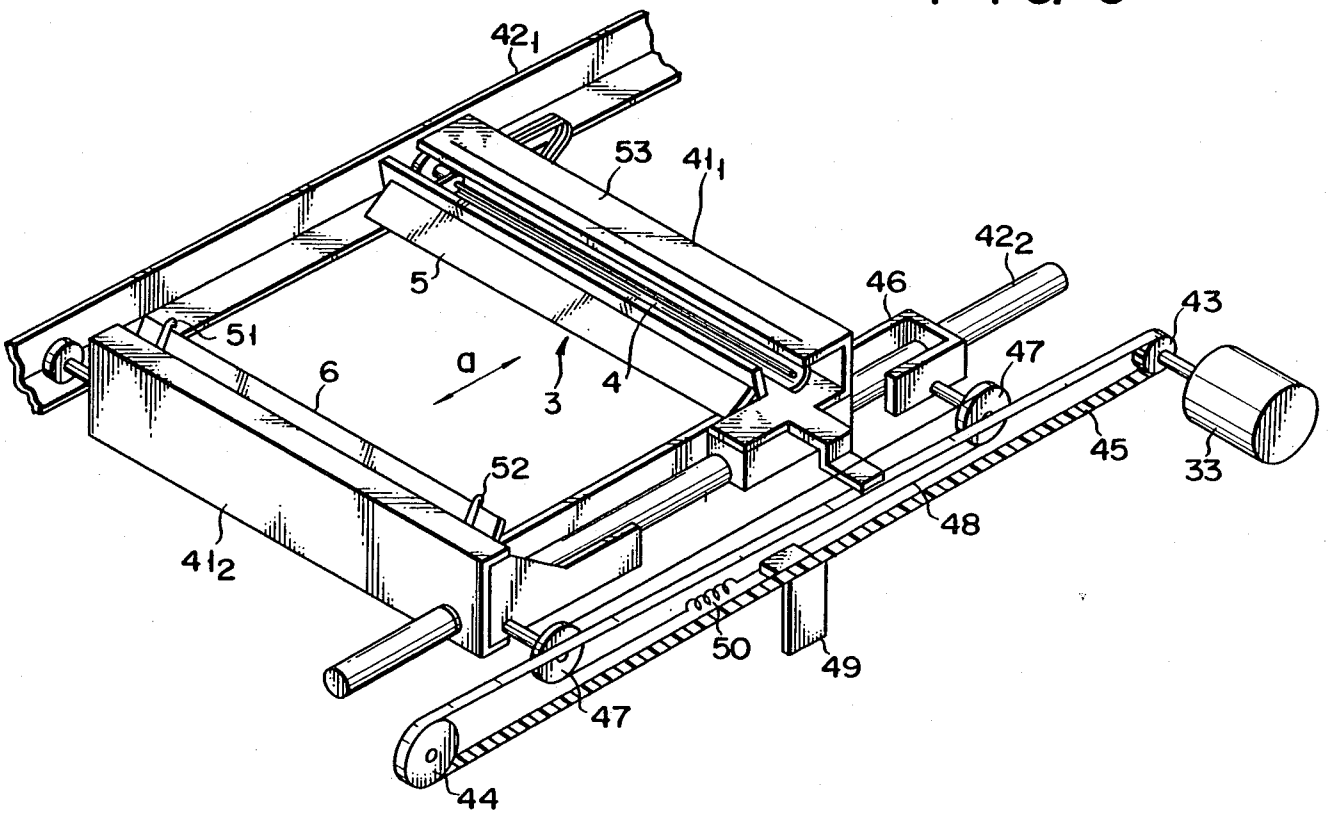

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage 411 supporting the mirror 5 is fixed to the middle portion of the belt 45.

On the other hand, two pulleys 47 are rotatably attached to a guide portion 46 (for the rail 422) of the second carriage 412 supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage 411 is fixed to the middle portion of the wire 48.

With this arrangement, when the pulse motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$

$$y = Py/K.$$

Out of the coordinates (x, y) dseignating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
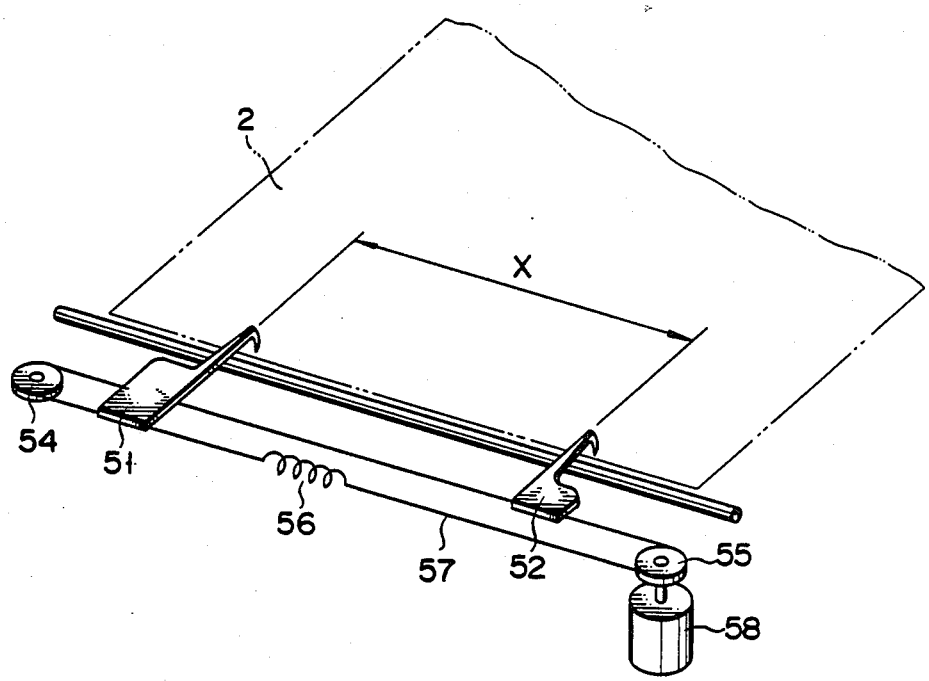

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 7:
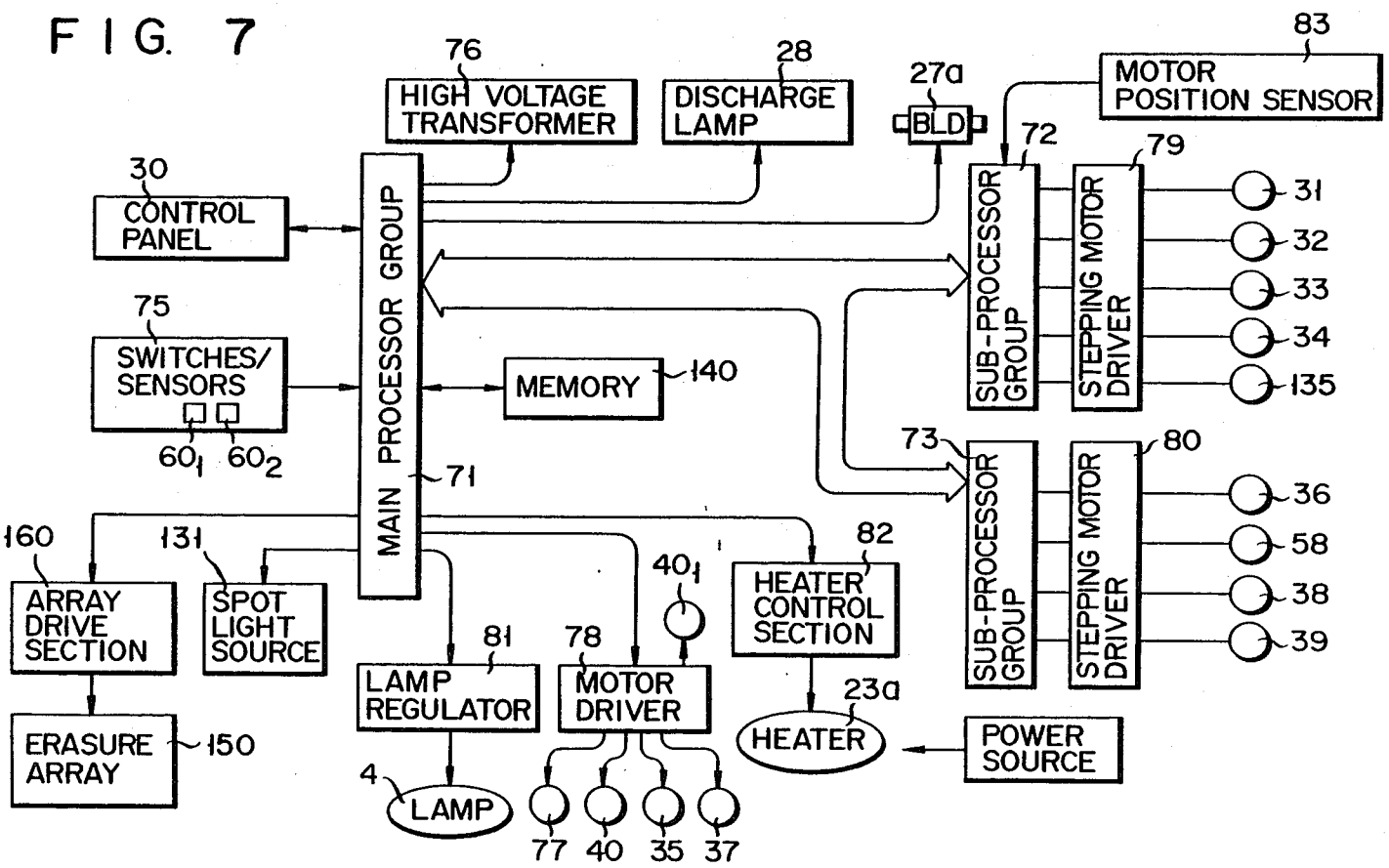

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches $60_1$ and $60_2$ and controls a high-voltage transformer 76 for driving the chargers, the discharge lamp 28, a blade solenoid 27*a* of the cleaner 27, a heater 23*a* of the fixing roller pair 23, the exposure lamp 4, and the motors 31 to 40, 58 and 77, thus accomplishing the copying operation. The main processor group 71 also controls a spot light source 131, a stepping motor 135, an erasure array 150, an array drive section 160, and a memory 140, thereby erasing any unnecessary portions of the original. These components 131, 135, 150, 160 and 140 will be described in detail later.

The motors 35, 37 and 40, $40_1$ and a toner-supply motor 77 for supplying the toner to the developing unit 12 are connected through a motor driver 78 to the main processor group 71 to be controlled thereby. The motors 31 to 34 and 135 are connected through a stepping motor driver 79 to the first subprocessor group 72 to be controlled thereby. The motors 36, 38, 39 and 58 are connected through a stepping motor driver 80 to the second subprocessor group 73 to be controlled thereby.

Further, the exposure lamp 4 is controlled by the main processor group 71 through a lamp regulator 81, and the heater 23*a* by the main processor group 71 through a heater control section 82. The main processor group 71 gives instructions for the start or stop of the individual motors to the first and second sub-processor groups 72 and 73. Thereupon, the first and second subprocessor groups 72 and 73 feed the main processor group 17 with status signals indicative of the operation mode of the motors. Also, the first sub-processor groups 72 is supplied with positional information from a position sensor 83 for detecting the respective initial positions of the motors 31 to 34 and 135.

Figure 8:
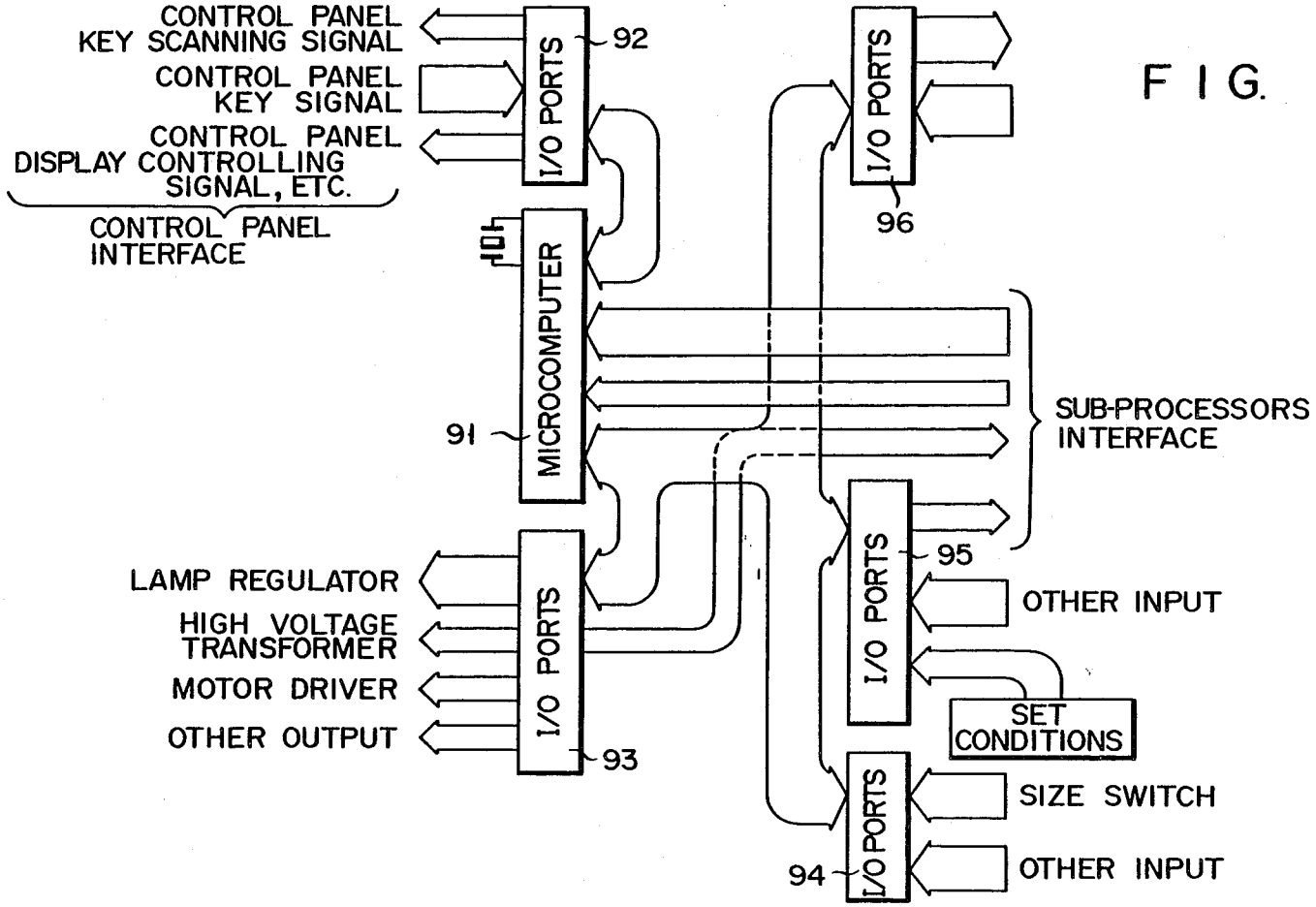

FIG. 8 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 9:
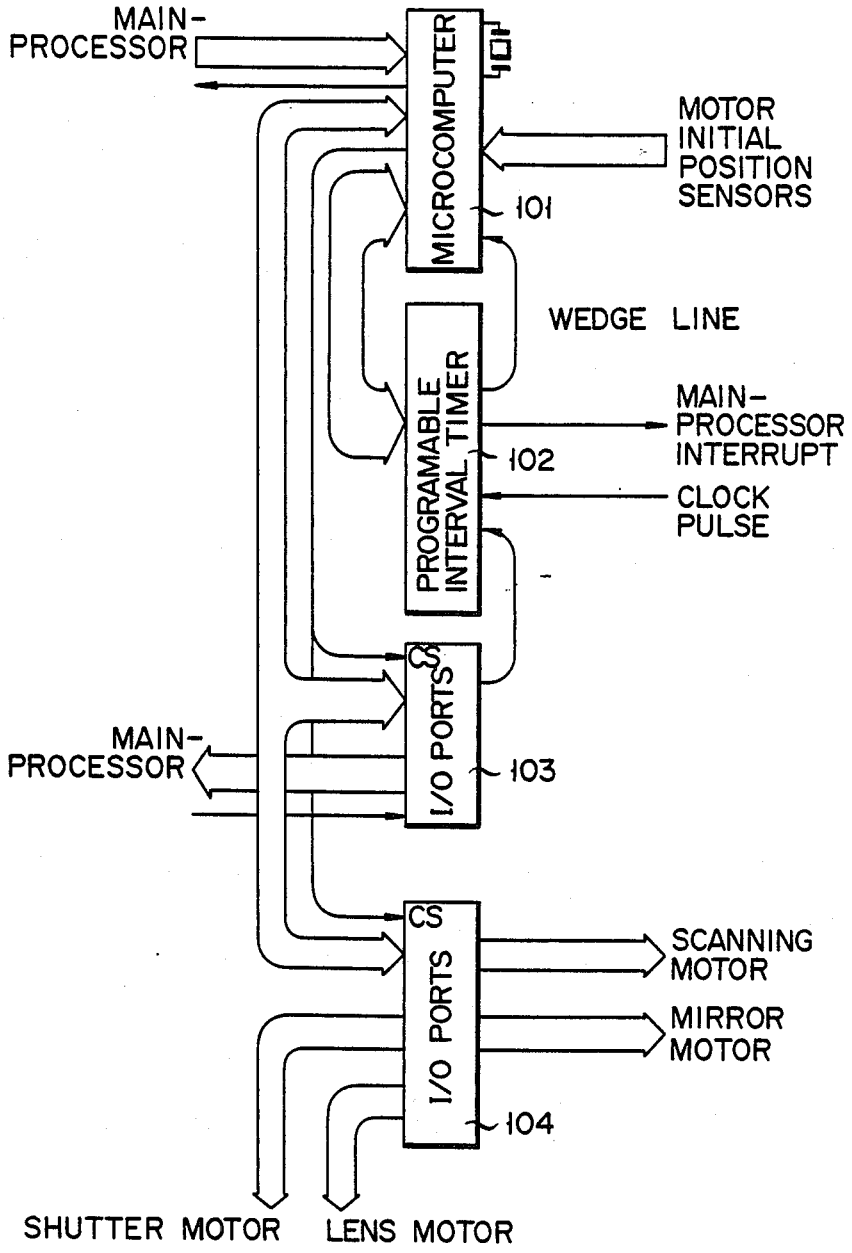

FIG. 9 shows an arrangement of the first subprocessor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34, 67 and 135 through the stepping motor driver 79. The port 103 is used to supply a status signal from each pulse motor to the group 71.

Figure 10:
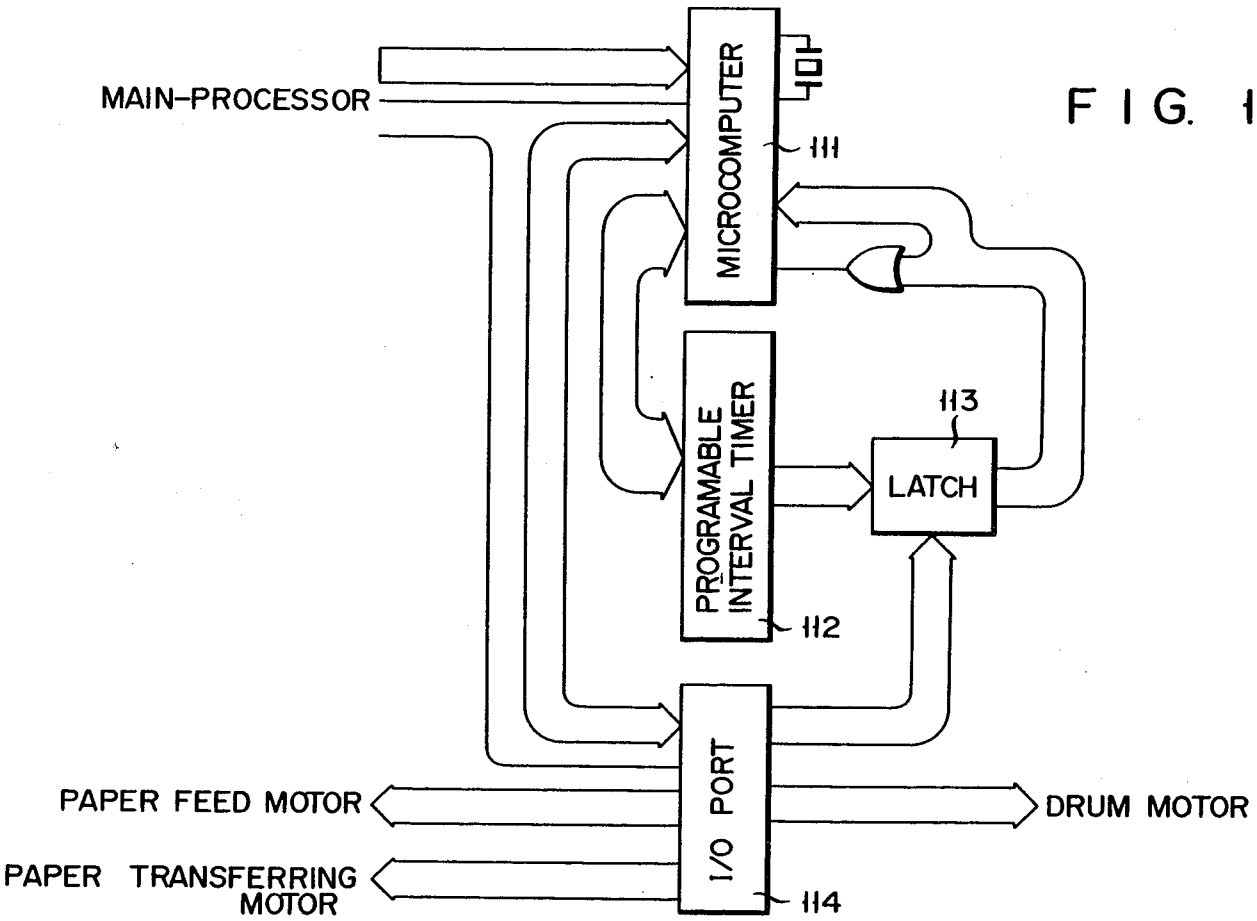

FIG. 10 shows an arrangement of the second subprocessor group 73. Reference numeral 111 denotes a CPU connected to the group 71. Reference numeral 112 denotes a programable interval timer for controlling switching time intervals of the stepping motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 11 shows a pulse motor control circuit. An I/O port 121 (corresponding to the ports 104 and 114 of FIGS. 11 and 12) is connected to a stepping motor driver 122 (corresponding to the drivers 79 and 80 of FIG. 9). The driver 122 is connected to windings A, $\overline{A}$, B and $\overline{B}$ of a stepping motor 123 (corresponding to the motors 31 to 34, 36, 38, 39, 58 and 135).

FIGS. 12A and 12B show a method of controlling a stepping motor speed. FIG. 12A shows a stepping motor speed curve, and FIG. 12B shows switching intervals. As is apparent from FIGS. 12A and 12B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 13:
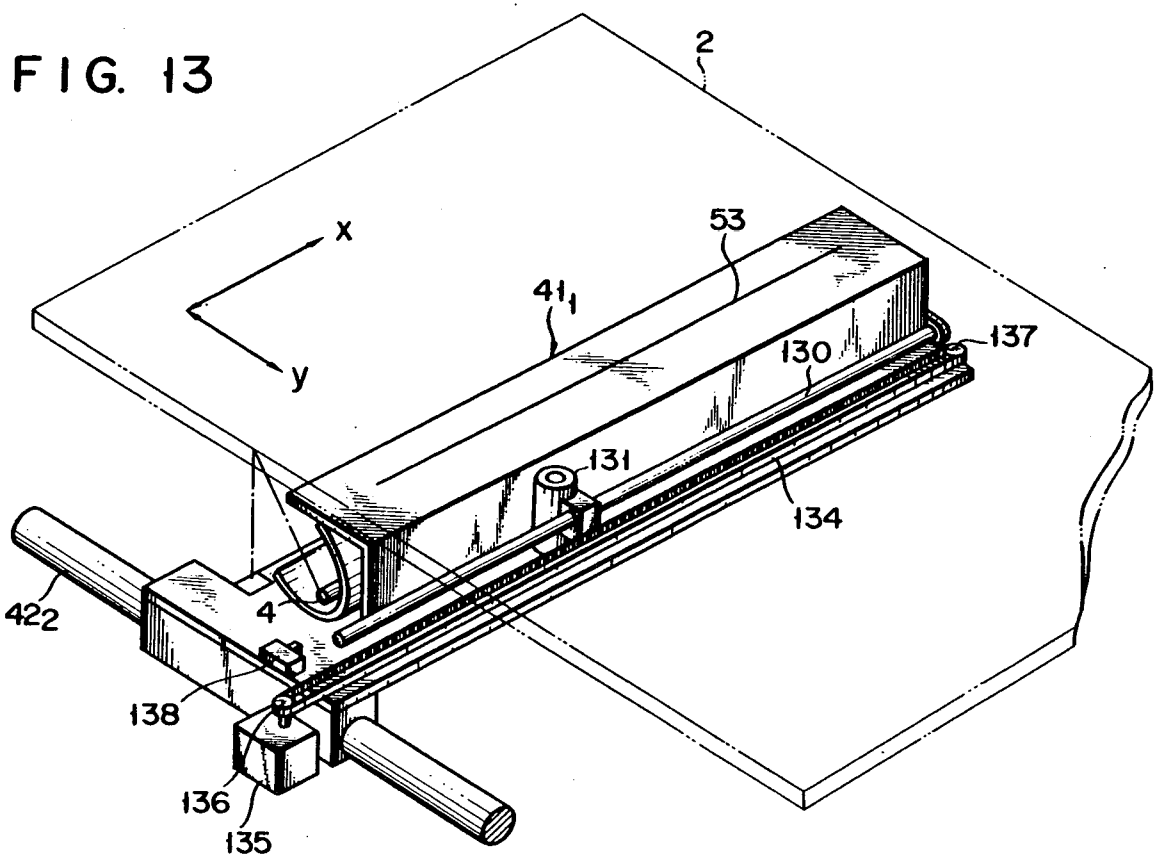
Figure 14:
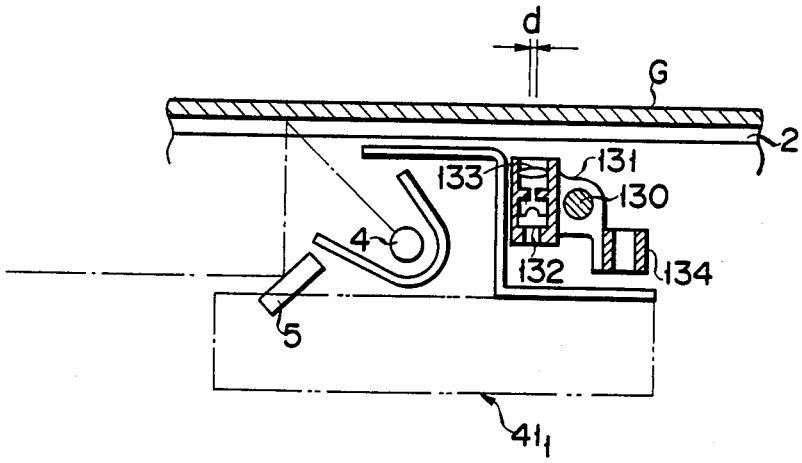
Figure 15:
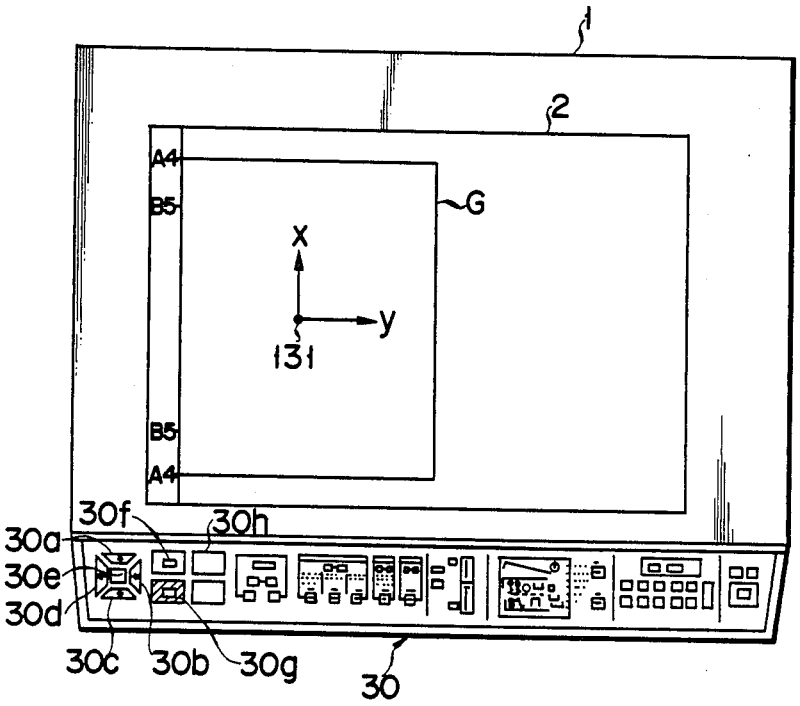

In FIGS. 13 and 14, a guide shaft 130 is disposed at that portion of the first carriage $41_1$ intercepting the light from the lamp 5, extending along the lamp 4. The guide shaft 130 is movably fitted with the spot light source 131 as the indicating means for indicating an erasure range of the original. As shown in FIG. 14, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 138 to have its initial position detected thereby.

Referring now to FIGS. 15 to 19, there will be described a method for designating as the erasure range an unnecessary portion of the original by means of the spot light source 131.

The spot light source 131 is moved by operating the operation keys 30*a* to 30*d*. When the operation keys 30*b* and 30*d* are depressed, the motor 33 is started, and the first carriage $41_1$ and the spot light source 131 are moved in the scanning direction (indicated by arrow y in FIG. 15). When the operation keys 30*a* and 30*c* are depressed, on the other hand, the motor 135 is started, and the spot light source 131 is moved in a direction (indicated by arrow x in FIG. 15) perpendicular to the scanning direction.

Figure 16:
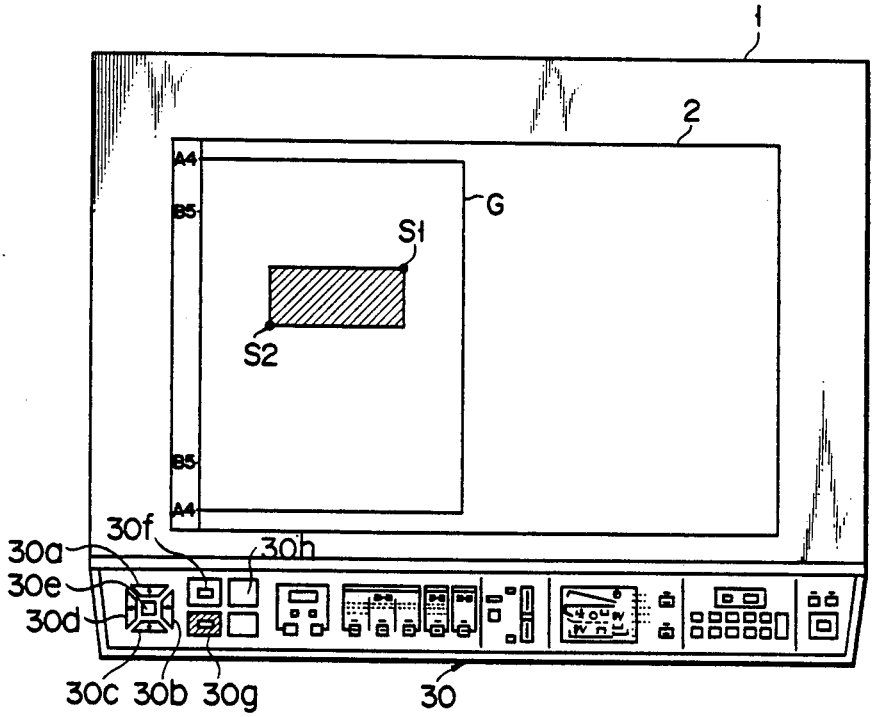

Observing the spot light transmitted through the original G, the operator operates the operation keys 30*a* to 30*d*. When the spot light reaches, for example, a spot S1 on the original G shown in FIG. 16, the operator depresses the position designating key 30*e*. Thereupon, the coordinate position indicated by the spot S1 is stored in the main processor group 71 shown in FIG. 7. Likewise, if the position designating key 30*e* is depressed when a spot S2 on the original G is reached by the spot light, the position of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 16.

Figure 17:
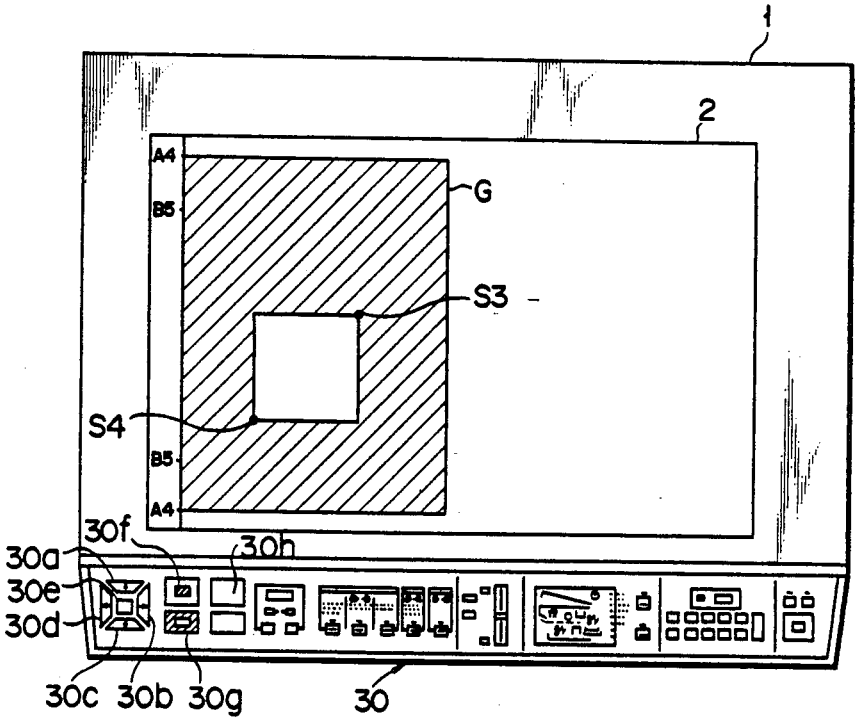

If the erasure range designating key 30*g* is depressed after designating spots S3 and S4 on the original G, the other region of the original G (i.e. not a square region having its two opposite vertexes on the spots S3 and S4) is designated as the erasure range, as shown in FIG. 17. Thus, if the erasure range designating key 30*f* or 30*g* is depressed, the main processor group 71 executes calculation in accordance with the positions of the two designated spots, and high- and low-level signals "1" and "0" are stored in those addresses of the memory 140 for the erasure range and the remaining region, respectively.

Figure 18:
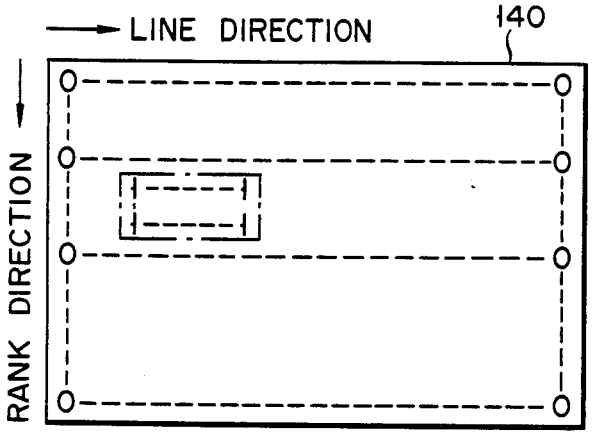

A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 16 and 17, high level signals are stored at addresses corresponding to the hatched area and low level signals are stored at other addresses in response to the data supplied from the group 71, as shown in FIGS. 18 and 91, respectively.

Figure 19:
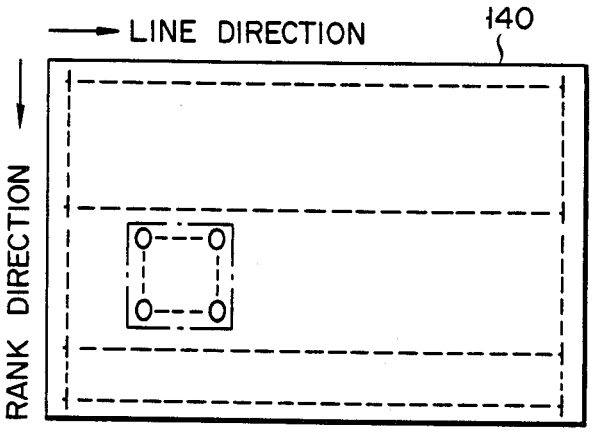

In this manner, the original is placed in the original table such that the image surface faces upward. When an erasure area is specified, the original is turned over along fixed scale $2_1$ on table 2. Therefore, information stored in memory 140 shown in FIGS. 18 and 19 is stored such that column order is inverted in practice.

Figure 20A:
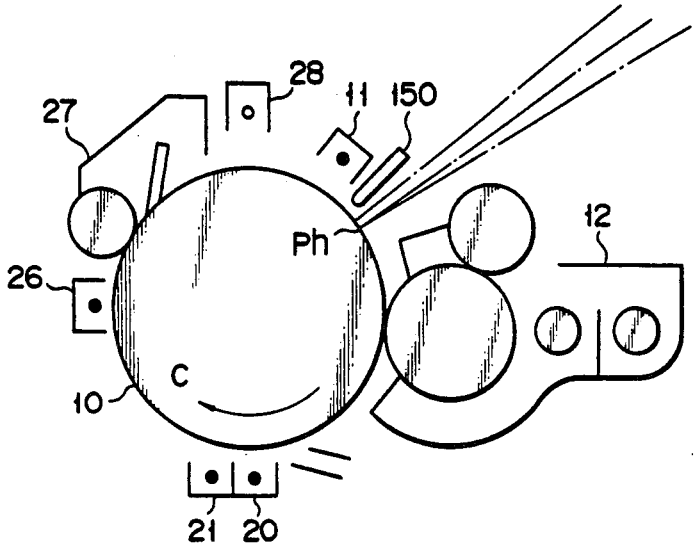
FIG. 20A is a side sectional view of the principal part showing an arrangement of the erasure array.
Figure 21:
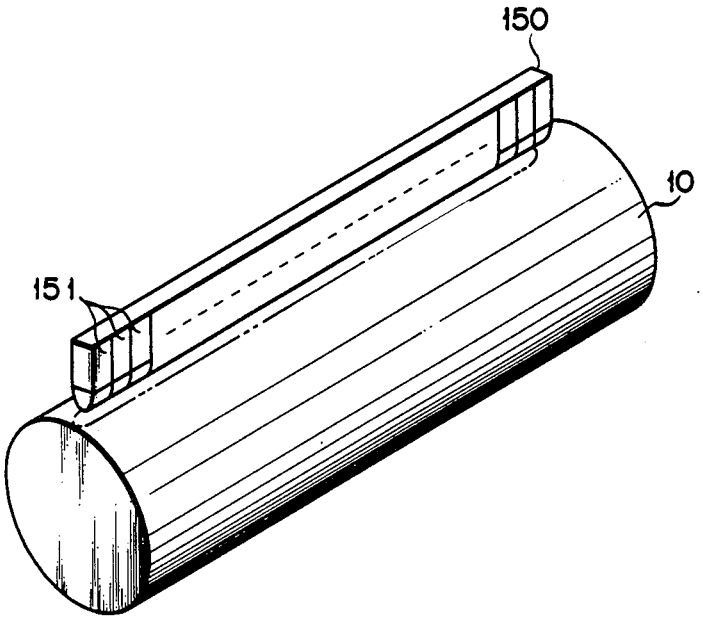
Figure 22:
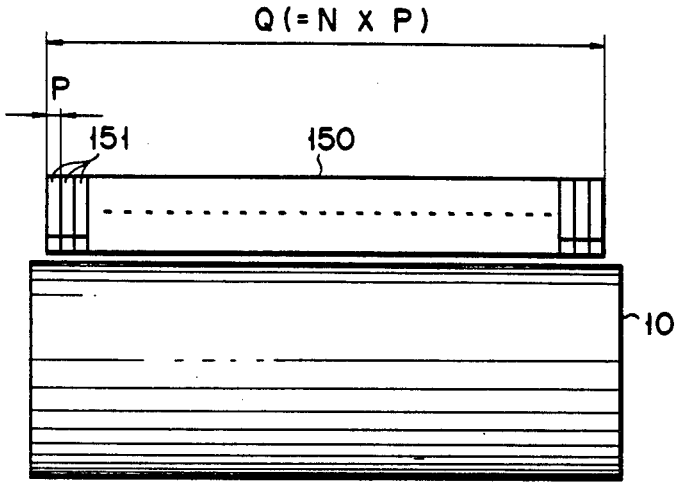
Figure 23A:
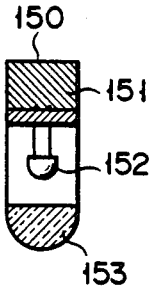
FIG. 23A is a side sectional view of the erasure array.
Figure 23B:
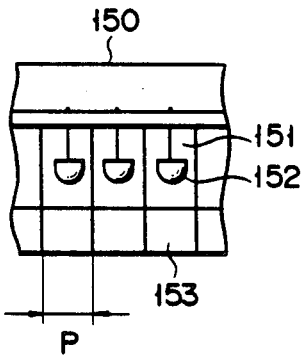
FIG. 23B is a partial front view of the erasure array.

As shown in FIG. 20A, on the other hand, the erasure array 100 as the erasing means is disposed close to the photosensitive drum 10, between the charger 11 and an exposure region Ph, for example. As shown in FIGS. 21 and 22, the erasure array 150 includes a plurality of shading cells 151 which are arranged in a direction perpendicular to the rotating direction of the photosensitive drum 10. As shown in FIGS. 23A and 23B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by Q=N·P.

Figure 24:
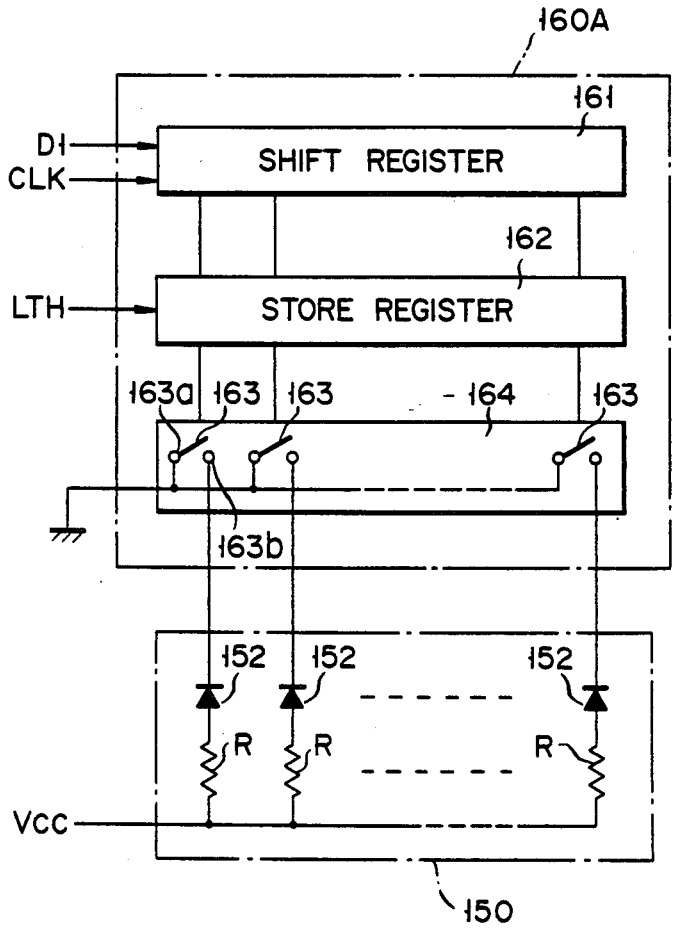

The array 160 is driven by an array drive section 160. As shown in FIG. 24, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After, as the erasure area the unnecessary portion of the original is specified, he closes the original cover $1_1$ and depresses the key $30_1$. The carriage $41_1$ and drum 10 are driven, and one-rank data are sequentially read out along the line direction (FIGS. 18 and 19) of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta l/\omega$ where $\theta l$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are tuned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank is erased. The data is thus read out from the memory 140 in units of ranks, thereby erasing the unnecessary image portion.

A main portion of the first embodiment of the present invention will now be described.

According to the present invention, an original portion to be underlined is specified by spot light source 131, and the specified portion is underlined.

Figure 25A:
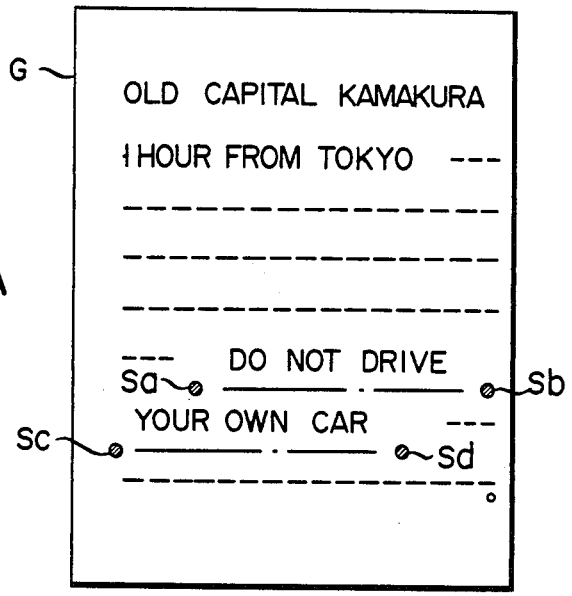
FIGS. 25A and 25B are diagrams showing underlined examples.
Figure 26:
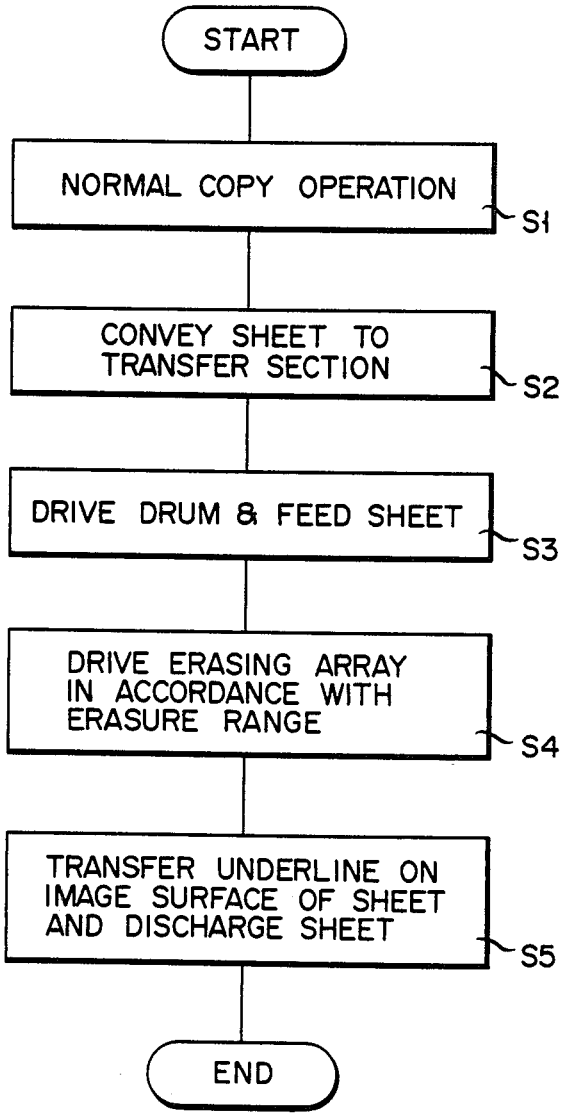

More specifically, key 30*h* is depressed to set main processor group 71 in the underlining mode. Thereafter, in the same manner as in the erasure range specifying mode, operation keys 30*a* to 30*d* and position specifying key 30*e* are operated to specify a portion to be underlined. FIG. 25A shows an example of this specifying operation. A range defined by points Sa to Sd is an underlining range. When key $30_1$ is depressed after the underlining range is specified in this manner, the copying operation is performed in accordance with the flow chart shown in FIG. 26.

Figure 27:
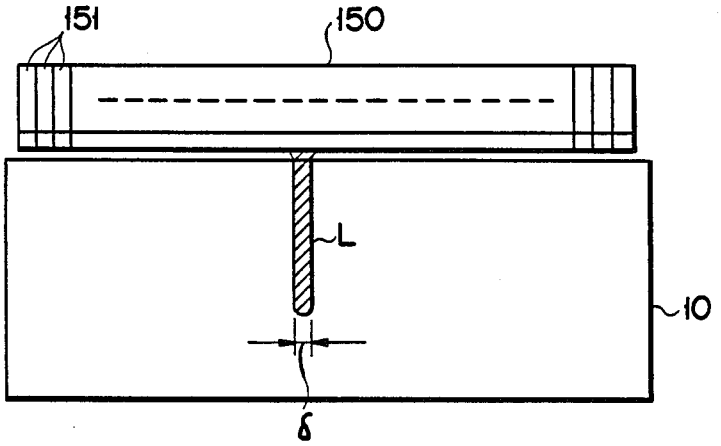

In step S1, lamp 4 is turned on to expose the original and to start the normal copy operation. When the normal copy operation is completed, unit $60_3$ is operated to again feed the sheet having the image formed thereon to drum 10, in step S2. When the sheet is fed close to drum 10, drum 10 is driven and the sheet is fed at a controlled timing, in step S3. In step S4, array 150 is turned on/off according to the specified range. That is, elements 152 outside the specified range are turned on and elements 152 within the range are left off. During this operation, lamp 4 is turned off and original exposure is not performed. Therefore, surface charge remains only on the specified range of drum 10 and is discharged from the remaining surface portions. An electrostatic latent image formed in this manner is developed by unit 12. FIG. 27 shows an example of the image formed in this manner. Reference symbol L denotes an underline formed on drum 10.

Figure 28A:
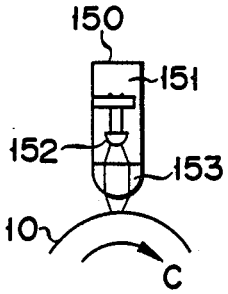
Figure 28B:
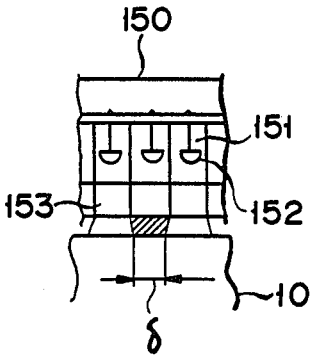

Light from ON elements 152 of array 150 is focused along the rotating direction of drum 10 and dispersed to a certain extent along the longitudinal direction thereof, as shown in FIGS. 28A and 28B. For this reason, width $\delta$ of the residual charge on drum 10 which corresponds to OFF element 152 is slightly narrower than pitch P of elements 152.

Figure 25B:
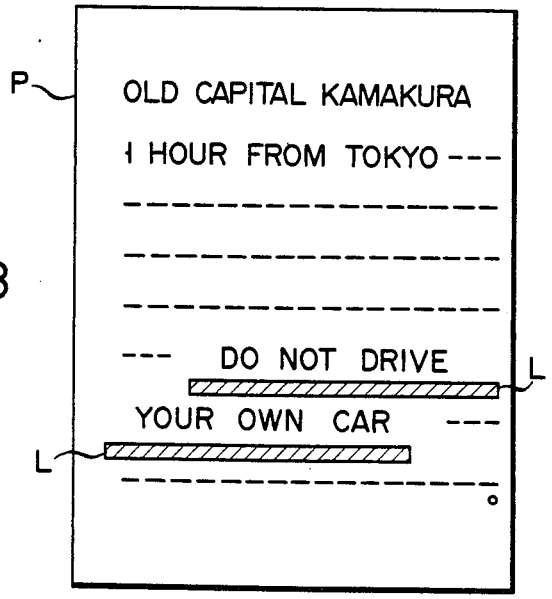

Toner image of underline L developed on drum 10 is transferred to the sheet in step S5 and the image is fixed. The sheet having the fixed image thereon is then discharged from the apparatus. In this manner, underline L is formed in the specified range, as shown in FIG. 25B.

According to the first embodiment described above, a predetermined range of an original image is designated by spot light source 131, and the image outside the specified range is erased by array 150. This facilitates image editing. In addition, since a predetermined range specified by light source 131 can be underlined, more flexible editing can be performed.

A second embodiment of the present invention will be described hereinafter. If no description is given, the constitution of the second embodiment is the same as that of the first embodiment.

Figure 29:
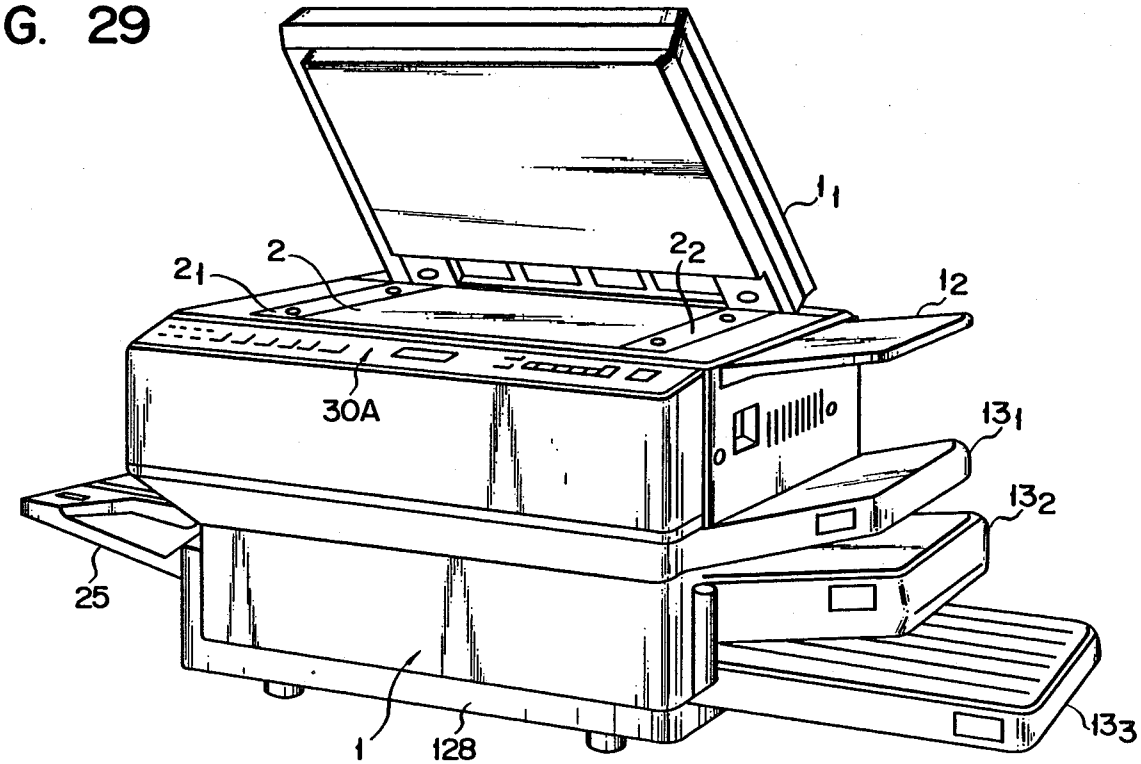
Figure 30:
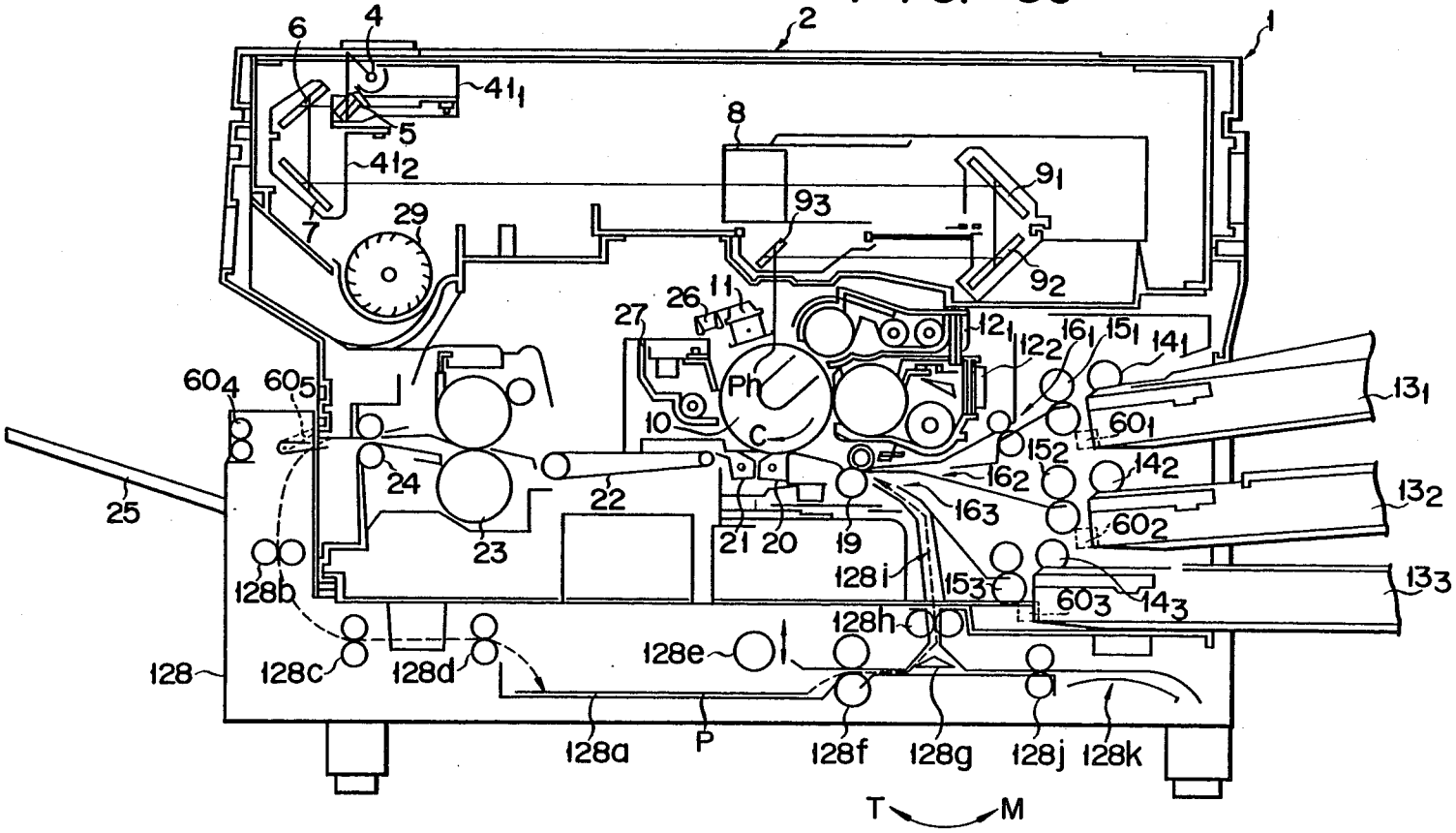

Referring to FIGS. 29 and 30 showing the schematic arrangement of the copying machine of the second embodiment, light is reflected by an original upon scanning by the optical system. Light reflected by the original upon illumination by exposure lamp 4 is reflected by mirrors 5, 6 and 7 and is transmitted through variable lens block 8. The transmitted light is reflected by mirrors $9_1$, $9_2$ and $9_3$ and is guided to photosensitive drum 10, so that an image of the original can be formed on the surface of drum 10. The latent images formed on drum 10 is applied with red or black toner by developing units $12_1$ and $12_2$, which are selectively operated so that the latent image can be produced as a visible image. Meanwhile, sheets (image forming media) P are selectively fed by feed rollers $14_1$, $14_2$ and $14_3$ and roller pairs $15_1$, $15_2$ and $15_3$ from upper, middle and lower cassettes $13_1$, $13_2$ and $13_3$ one by one. Each sheet is guided to aligning roller pair 19 along guide path $16_1$, $16_2$ or $16_3$ and is fed by pair 19 to the transfer section. It should be noted that cassettes $13_1$, $13_2$ and $13_3$ are detachably attached to the lower portion at the right side of housing 1. One of the cassettes must be selected at the operation panel (to be described later). Sizes of cassettes $13_1$, $13_2$ and $13_3$ are detected by cassette size detection switches $60_1$, $60_2$ and $60_3$, respectively. Switches $60_1$, $60_2$ and $60_3$ comprise a plurality of microswitches which are turned on/off upon the insertion of cassettes of different sizes.

Two-side multicopying unit 128 is arranged at the lower portion of housing 1 to perform two-side copying or multicopying for copying different images on the same sheet surface. Unit 128 has selection gate $60_5$, discharge roller pair $60_4$, and a plurality of roller pairs 128*b*, 128*c* and 128*d* for guiding the sheet from gate $60_5$ to stacking portion 128*a*. Feedout roller 128*e* is arranged in portion 128*a* to feed out the sheets temporarily stacked in portion 128*a*. Roller 128*e* can be moved vertically in the direction of the arrow in accordance with the thickness (number) of stacked sheets. The sheets fed by roller 128*e* are separated by separation roller pair 128*f* one by one, and each sheet is guided to control gate 128*g*. Gate 128*g* is pivoted in the M direction when multicopying is performed, so that the sheet is guided to roller pair 19 through convey roller pair 128*h* along sheet guide path 128*i*. However, when two-side copying is performed, gate 128*g* is set to the position illustrated in FIG. 30, so that the sheet is guided to inverting portion 128*k* through roller pair 128*j*. When the sheet is fed to portion 128*k*, gate 128*g* is pivoted in the T direction, so that it is guided to pair 19 through pair 128*h* along path 128*i*.

FIG. 31 shows control panel 30A used in a second embodiment of the present invention. Control panel 30A has black original specifying key 30*i* for specifying developing unit $12_2$ containing black toner so as to form a black image, red original specifying key 30*j* for specifying developing unit $12_1$ containing red toner so as to form a red image, red line key 30*k* for specifying formation of a red line such as a red underline on a sheet having a black image, black line key 30*l* for specifying formation of a black line such as a black underline on a sheet having a red image, and width indicators 30*m* and 30*n* for indicating the widths of lines to be formed, which are specified by the number of times keys 30*k* and 30*l* are depressed.

Figure 32:
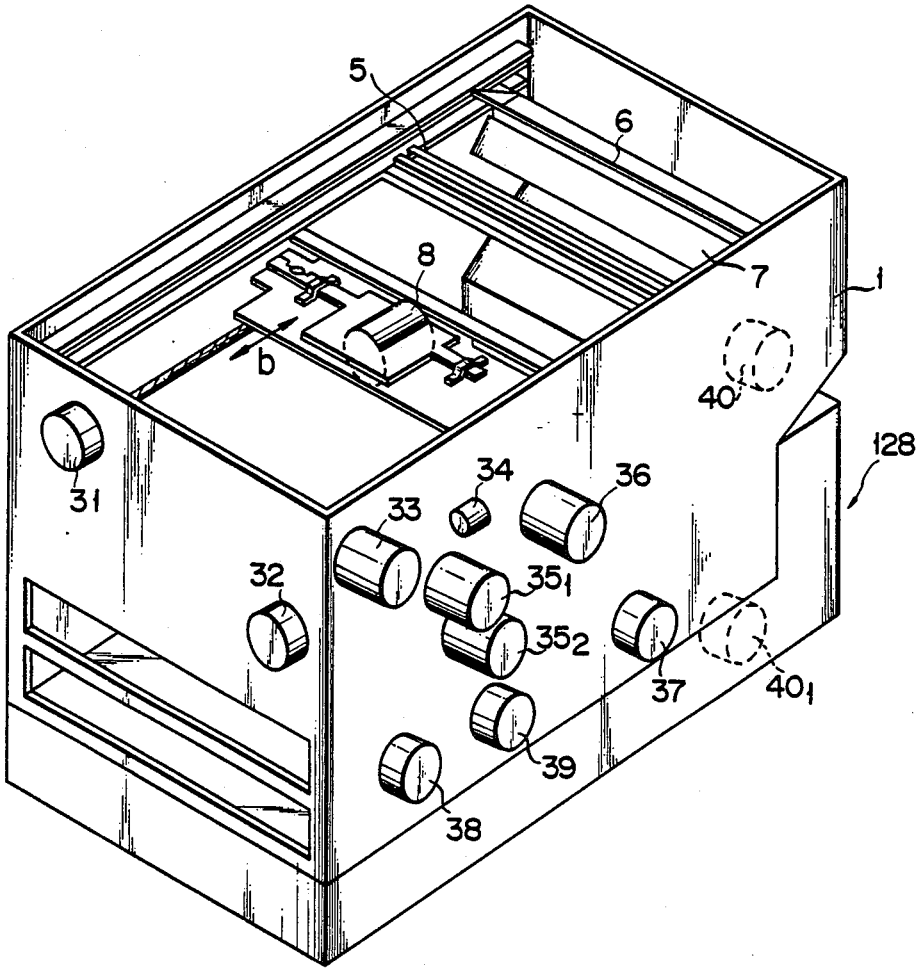

FIG. 32 shows a configuration of a drive source in each drive section in the second embodiment. Referring to FIG. 32, reference numerals $35_1$ and $35_2$ denote developing motors for driving the developing rollers of units $12_1$ and $12_2$. In the second embodiment, motor $40_1$ is used to drive roller pairs 128*b*, 128*c*, 128*d* and so on.

Figure 33:
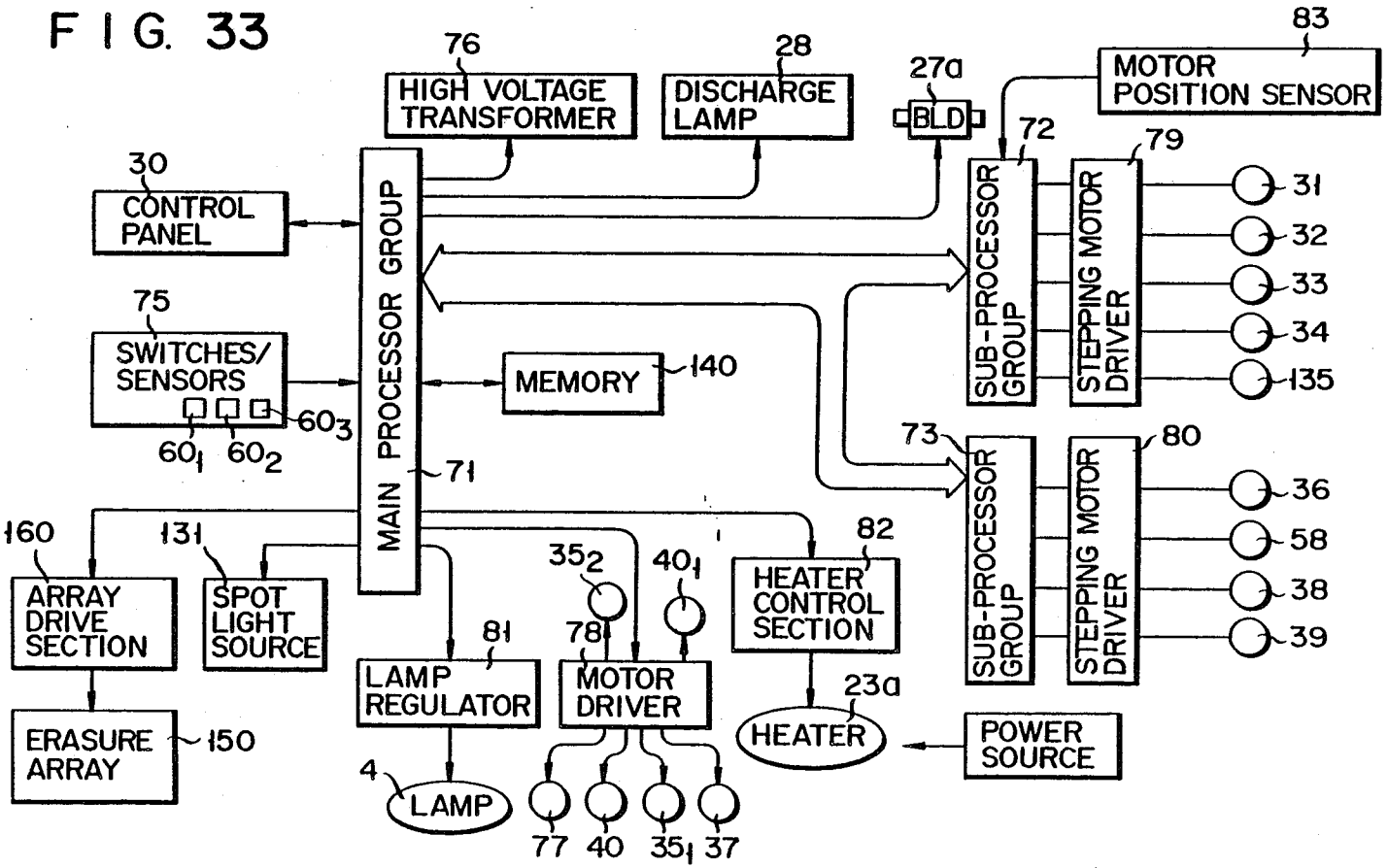

FIG. 33 is a block diagram showing the overall control circuit in the second embodiment. Referring to FIG. 33, cassette size detection switch $60_3$ is added to switches/sensors 75. Motor driver 78 drives motors $35_1$ and $35_2$. In accordance with inputs from switches/sensors 75, main processor group 71 and first and second subprocessor groups 72 and 73 control their respective parts of the apparatus.

The configuration, function, and operation of each part for specifying an erasure range are the same as those in the first embodiment.

The main portion of the second embodiment of the present invention will be described below. Using units $12_1$ and $12_2$ and spot light source 131, a given portion of a black or red original image is specified, the black or red image is formed, and an underline or a line image can be formed in red or black specified by key 30*k* or 30*l* to be superposed on the black or red image.

More specifically, a black original, e.g., is set on original table 2 and key 30*i* is depressed. Key 30*k* is then depressed to set group 71 in the line mode. Operation keys 30*a* to 30*d* and position specifying key 30*e* are operated in the same manner as in specifying the erasure range, so as to specify a range in which to form a line, such as an underline (FIG. 25A).

Figure 34A:
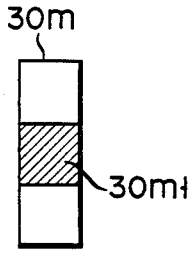
FIGS. 34A to 34C are diagrams for explaining the display states of a width indicator with a line key.
Figure 34B:
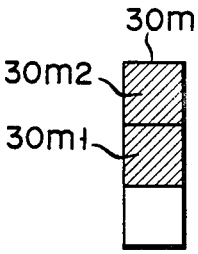
Figure 34C:
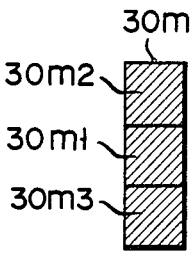
Figure 35:
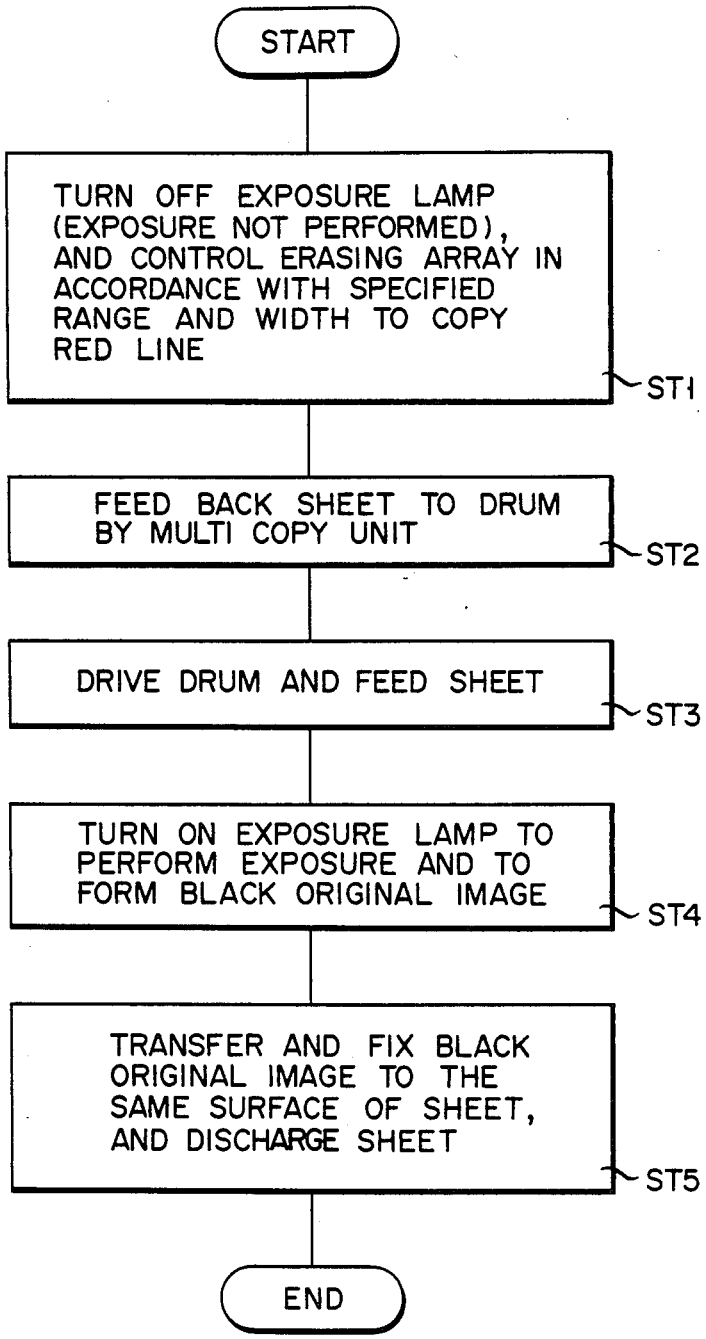

In order to specify the width of a line to be formed, key 30*k* is depressed one of three times, corresponding to three different widths. When key 30*k* is depressed once, only central light-emitting element 30*m*1 of width indicator 30*m* is turned on to set a minimum line width, as shown in FIG. 34A. When key 30*k* is depressed twice, elements 30*m*1 and 30*m*2 are turned on to set a width twice the minimum line width, as shown in FIG. 34B. When key 30*k* is depressed three times, elements 30*m*1, 30*m*2, and 30*m*3 are turned on to set a width three times the minimum line width, as shown in FIG. 34C. When key 30*k* is depressed a fourth time, indicator 30*m* again sets the minimum width shown in FIG. 34A. When a desired line range and width has been specified and copy key $30_1$ is depressed, multi-color copy operation is performed in accordance with the flow chart shown in FIG. 35.

When keys 30*i* and 30*k* are depressed, exposure lamp 4 is turned off (i.e., an exposure operation is not performed), and array 150 is turned on/off in accordance with a range and width specified in the above manner, in step ST1. If the selected width is the minimum line width, one corresponding element 152 is left off while remaining elements 152 are turned on, as shown in FIGS. 28A and 28B. Thus, surface charge remains only on the specified range of drum 10 and an electrostatic latant image is formed in the specified range. The image is developed by unit $12_1$ containing red toner, and a toner image of red line L is formed on drum 10, as shown in FIG. 27.

Light from ON element 152 is focussed in the rotating direction of drum 10 and is dispersed to a certain extent along the longitudinal direction thereof, as shown in FIGS. 28A and 28B. For this reason, width $\delta$ of the residual charge corresponding to OFF element 152 is slightly narrower than pitch P of elements 152.

The developed image of line L on drum 10 is transferred to the sheet and fixed. When red image formation is completed, multi-copy unit 28 is operated to feed the sheet having line L to a position upstream of drum 10, in step ST2. Then, in step ST3, drum 10 is driven, and the sheet is supplied thereto at a predetermined timing. In step ST4, exposure lamp 4 is turned on to expose the original, and an electrostatic latent image of the original image is formed on drum 10. The latent image is developed by unit $12_2$ containing black toner. The developed black image on drum 10 is transferred to the same side of the sheet having line L and fixed, and the sheet is discharged from the apparatus, in step ST5.

On the discharged sheet, red line L (underline) is formed in a specified range on a black original image, as shown in FIG. 25B.

Figure 36:
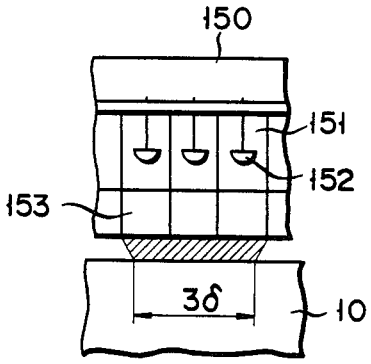
Figure 37A:
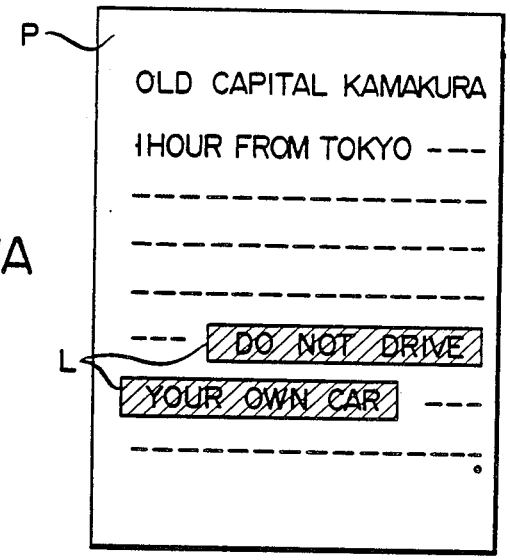

When the width of line L is set to be maximum by key 30*k*, in step ST1, elements 152 other than the three elements 152 corresponding to the specified range are turned on, as shown in FIG. 36. Red line L of maximum width is formed in a specified range on sheet P, shown in FIG. 37A. When a black original image is superposed in step ST5, the specified range is emphasized in red.

The reason for performing multi-color copy in this manner is as follows: when a specified area of an original image is to be emphasized in red, if a red line is superposed on a black original image, light reflected from the underlying image is partially shielded by overlying toner and is therefore hard to see.

In the above embodiment, a given area of an original is specified by light source 131, and the image outside the specified area is erased by array 150, making original editing easy to perform.

In addition, a line of a different color can be formed in a given area on the original which is specified by spot light source 131, and the width of the line can be varied. Therefore, a given area of the original image can be emphasized by such a line.

As described in detail above, according to the second embodiment of the present invention, there is provided an image forming apparatus which can selectively erase a given portion of an original image and which can form a solid line image of a predetermined width in a selected range, in a different color.

An application of the second embodiment of the present invention will now be described.

In this application, a given portion of a black or red original image is specified using spot light source 131. When the black or red original image is formed, the specified portion of the original image can be reproduced in a color specified by red or black line key **30*k* or 30*l***.

Figure 37B:
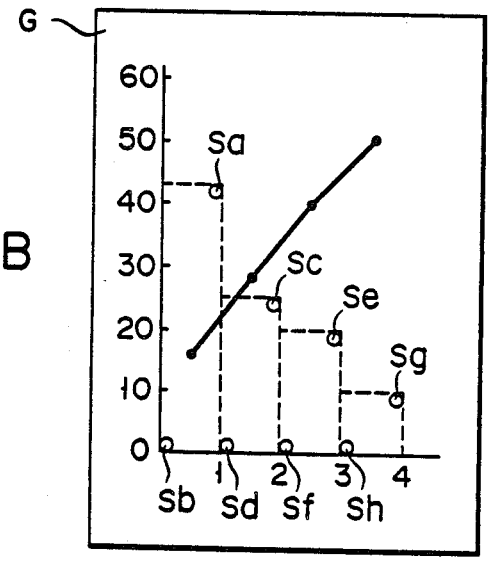

More specifically, an original is placed on table 2. Black original key **30*i* is depressed and red line key 30*k* is then depressed to set group 71 in the line mode. Thereafter, operation keys 30*a* to 30*d* and position specifying key 30*e* are operated in the same manner as the specifying operation of the erasure range, thereby specifying a portion of the original in which to form a solid line image. FIG. 37B shows an example of such an image. Note that Sa to Sh define portions between which solid line images can be formed on original G. When key $30_1$ is depressed after the solid image portions are formed as described above, low level signals are supplied to addresses of memory 140 corresponding to the solid image portions, while high level signals are supplied to remaining addresses thereof, under the control of group 71. Thereafter, the copy operation is performed in accordance with the flow chart in FIG. 35**.

Figure 37C:
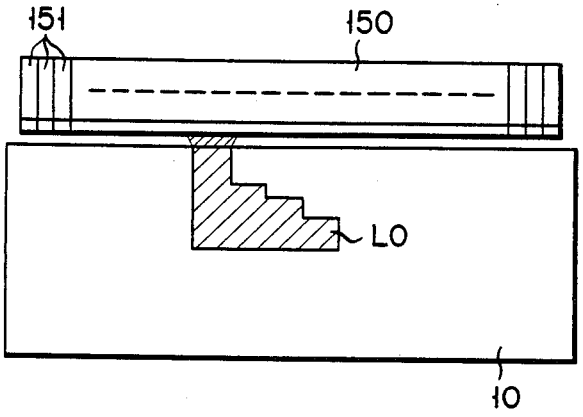

When keys **30*i* and 30*k* are selectively depressed in step ST1, exposure lamp 4 is turned off and elements 152 of array 150 are turned on or off in accordance with the specified range and width. As shown in FIGS. 34A, 34B, and 34C, elements 152 corresponding to the specified range are left off and remaining elements 152 are turned on, in accordance with the data stored in memory 140. During this operation, exposure lamp 4 is turned off, and the original is not exposed. Therefore, the surface charge only remains on a surface portion of drum 10 corresponding to the specified range and the charge on the remaining portion is erased. An electrostatic latent image formed on drum 10 is developed by unit $12_1$ containing red toner. FIG. 37C shows an example of such an image. Note that L0 corresponds to the specified range on drum 10**.

Figure 37D:
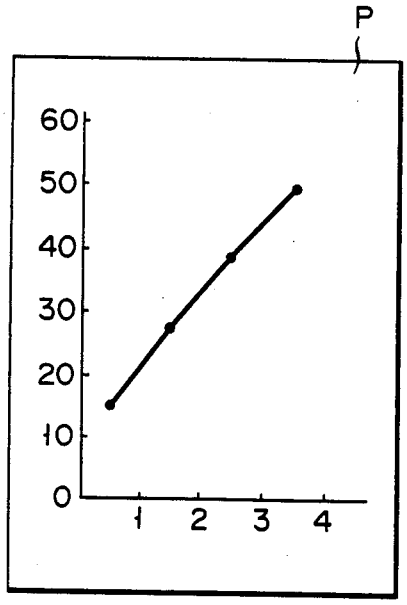

Toner image L0 on drum 10 is transferred onto a sheet and fixed to complete the red copy operation. In step ST2, multi-copy unit 28 is operated to feed the same sheet with image L0 to the upstream side of drum 10. In step ST3, drum 10 is driven, and the sheet is supplied thereto at a predetermined timing. In step ST4, the original is exposed, and an electrostatic latent image of the original image is formed on drum 10. The latent image is developed by unit $12_2$ containing black toner. The toner black original image on drum 10 is transferred to the same surface of same sheet P having image L0 thereon and is fixed, as shown in FIG. 37D, and the sheet is discharged, in step ST5.

Figure 37E:
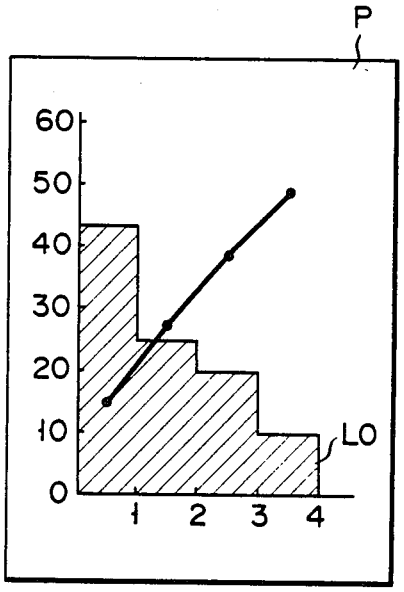

Thus, a black image having red image L0 in a given portion is formed on discharged sheet P, as shown in FIG. 37E.

According to this application, a given portion of an original can be specified by spot light source 131, and a solid image of a different color can be formed in the specified portion. Therefore, a bar graph, for example, can be superposed on an original image.

The application is not limited to the details described above. For example, a specified range of a black original image can have a solid red image formed such that the solid red image is superposed on the black original image.

The erasure range or solid image range can be specified by two points defining a line corresponding to the range or by diagonal points defining a desired range.

When the above application is applied to a copying machine having only a single developing unit, as in the first embodiment, a given portion of an original image can be formed as a solid image in the same color.

A third embodiment of the present invention will now be described. The details of the third embodiment are the same as the first embodiment unless otherwise stated.

Figure 38:
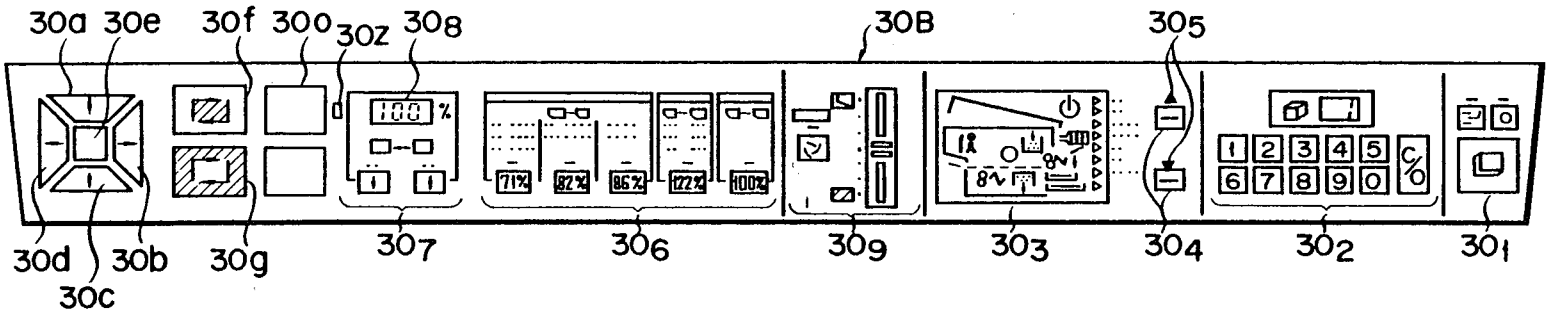

FIG. 38 shows control panel 308 used in the third embodiment. Control panel 30B has write specifying key **30*o* for specifying writing of an alphanumeric character on an image, and indicator 30*g* for indicating the ON/OFF state of key 30*o***.

Figure 39:
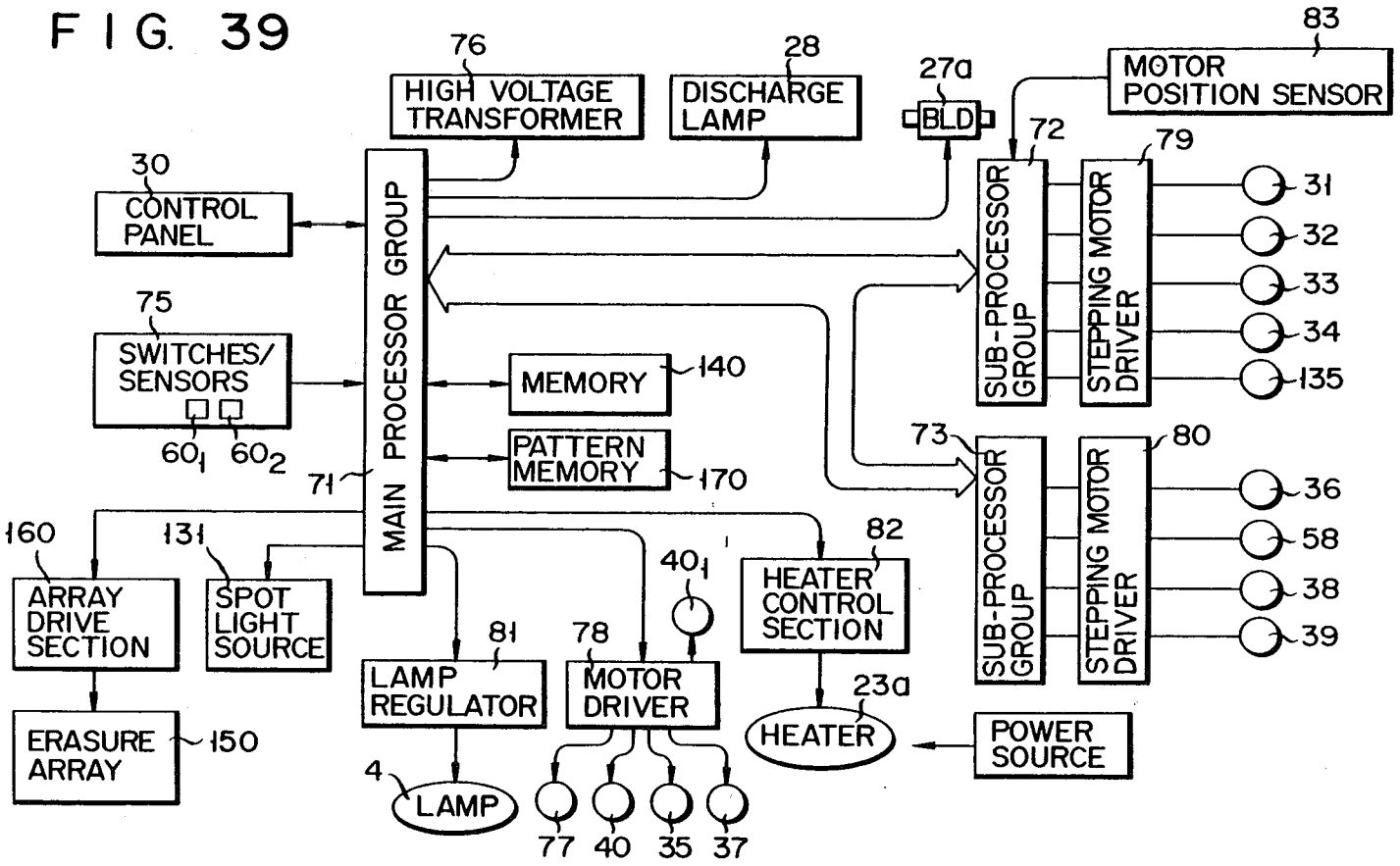

FIG. 39 shows an overall control circuit of the embodiment shown in FIG. 38. Note that reference numeral 170 denotes a pattern memory to be described later.

Pattern memory 140 stores patterns of alphanumeric characters, such as numerals or letters, which are generated by a character generator. A pattern from memory 140 is supplied to group 71 to control ON/OFF operation of array 150. Elements 152 not corresponding to the pattern are turned on, leaving only a desired surface charge pattern on drum 10.

The main portion of the third embodiment of the present invention will now be described.

In this embodiment, a given portion in a margin of an original is specified using spot light source 131. A pattern of an alphanumeric character such as a numeral or a letter, input through ten keys $30_2$ of panel 20 or spot light source 131, can be formed in the specified portion.

Figure 40A:
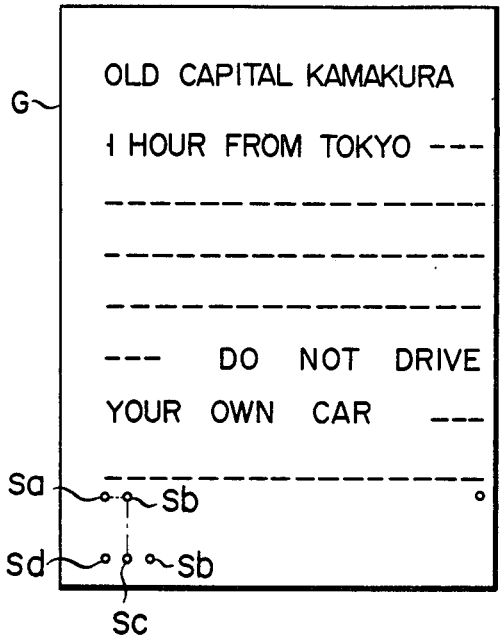
FIGS. 40A to 40D are diagrams showing examples of images of numerals and symbols as additional images.
Figure 41:
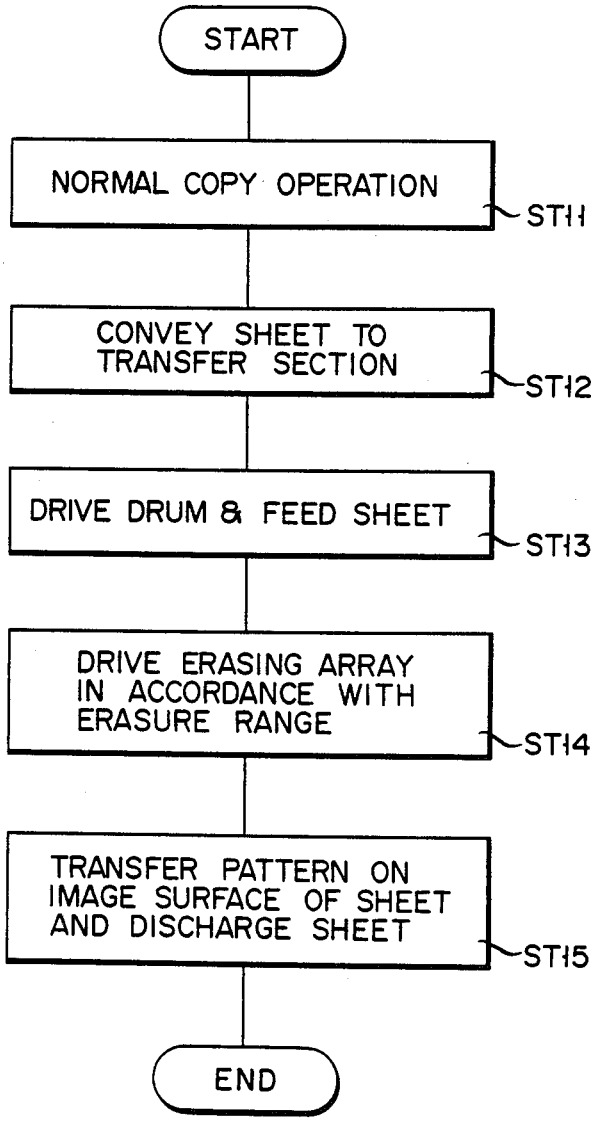

More specifically, original G is placed on original table 2. Write key $30_0$ is depressed to set group 71 in the character write mode. Next, one or more of ten keys $30_2$ of panel 30 are depressed to input a desired numeral, e.g., "1". Operation keys **30*a* to 30*d* and position specifying key 30*e* are operated in the same manner as in specifying the erasure range, so as to specify a numeral write portion (the lower left margin portion in the example illustrated in FIG. 40A). Note that a portion surrounded by Sa to Se is a range for forming an image of "1". When copy key $30_1$ is depressed after the write portion is specified in this manner, low level signals are supplied to addresses of pattern memory 170 corresponding to the write portion, while high level signals are supplied to the remaining addresses thereof. Thereafter, the copy operation is performed in accordance with the flow chart shown in FIG. 41**.

Figure 40B:
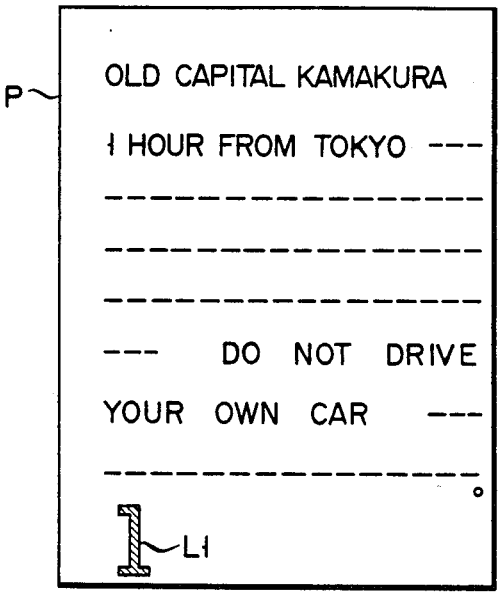
Figure 42:
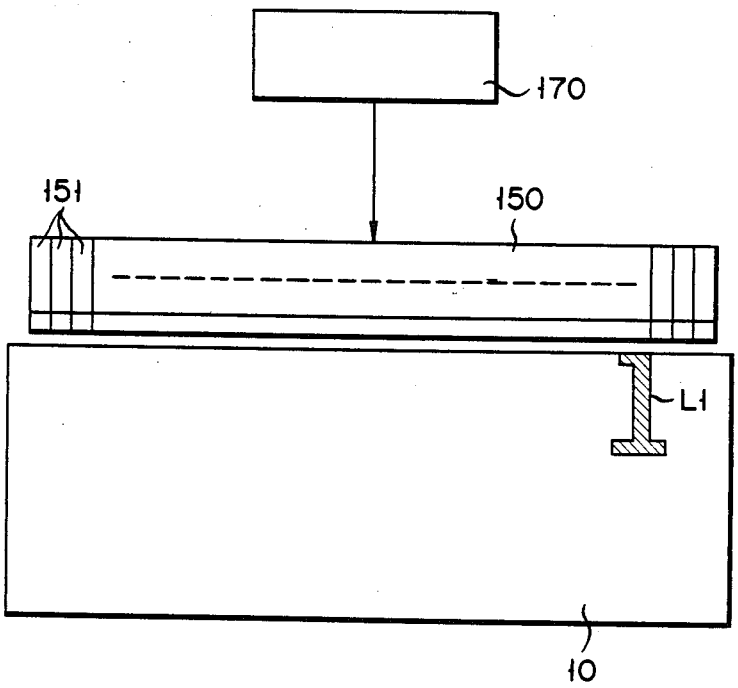

In step ST11, exposure lamp 4 is turned on, the original image is exposed, and a normal copy operation is performed. FIG. 40B shows an image of original G formed on sheet P by the above operation. When the copy operation is completed, multi-copy unit $60_3$ is operated, and the sheet having the original image is again supplied toward photosensitive drum 10. When the sheet is supplied toward drum 10, drum 10 is driven and the sheet is fed at a predetermined timing, in step ST13. In step ST14, elements 152 of array 150 are turned on/off in accordance with the specified portion. More specifically, elements 152 corresponding to the specified portion are turned off in accordance with the storage data in pattern memory 170, as shown in FIGS. 28A and 28B. At this time, exposure lamp 4 is off and original exposure is not performed. Thus, surface charge remains only on the specified portion of drum 10, and is erased from the remaining portions. An electrostatic latent image formed in the specified portion is developed by developing unit 12. The obtained toner image is shown in FIG. 42. Note that reference symbol L1 denotes a toner image in the specified portion on drum 10.

Toner image L1 on drum 10 is transferred to sheet P and fixed, and the sheet is discharged, in step ST5. Thus, image L1 of numeral "1" is formed in the specified portion, as shown in FIG. 40B.

Figure 40C:
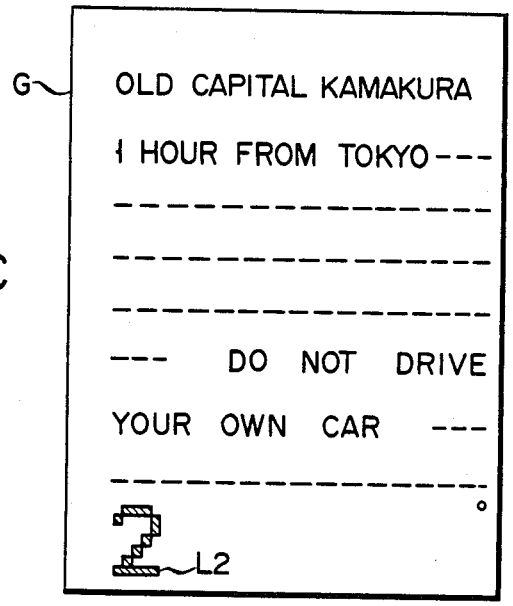
Figure 40D:
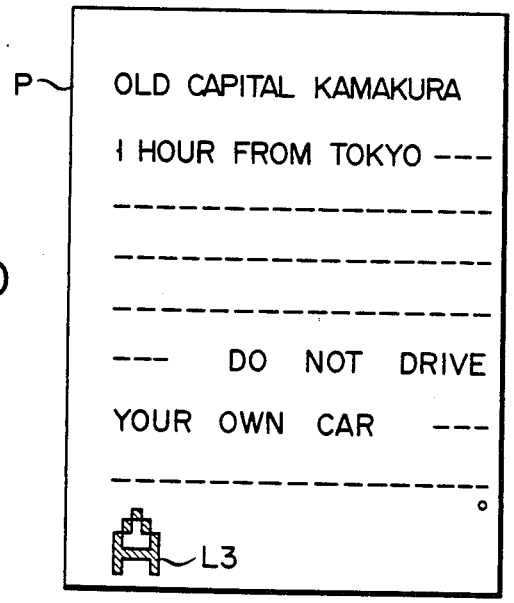

FIG. 40C shows an example wherein image L2 of numeral "2" is formed on sheet P, and FIG. 40D shows an example wherein image L3 of letter "A" is formed on sheet P.

In this embodiment, a given portion of an original is specified by spot light source 131, and an image outside the specified portion can be erased using array 150, thereby facilitating original editing.

When such a given portion of an original is specified by spot light source 131, a desired alphanumeric character, such as a numeral or letter, can be written in the specified portion.

According to the third embodiment described above, a portion outside a given portion of an original image can be selectively erased, and a desired alphanumeric character such as a numeral or letter can be written in the given portion.

When the third embodiment is applied to a copying machine having two developing units $12_1$ and $12_2$ and keys 30*i* and 30*j* specifying them, as in the second embodiment, the character can be written in the specified portion in a different color.

An application of this embodiment of the present invention will now be described. The details of the application are the same as the second embodiment unless otherwise stated.

Figure 43:
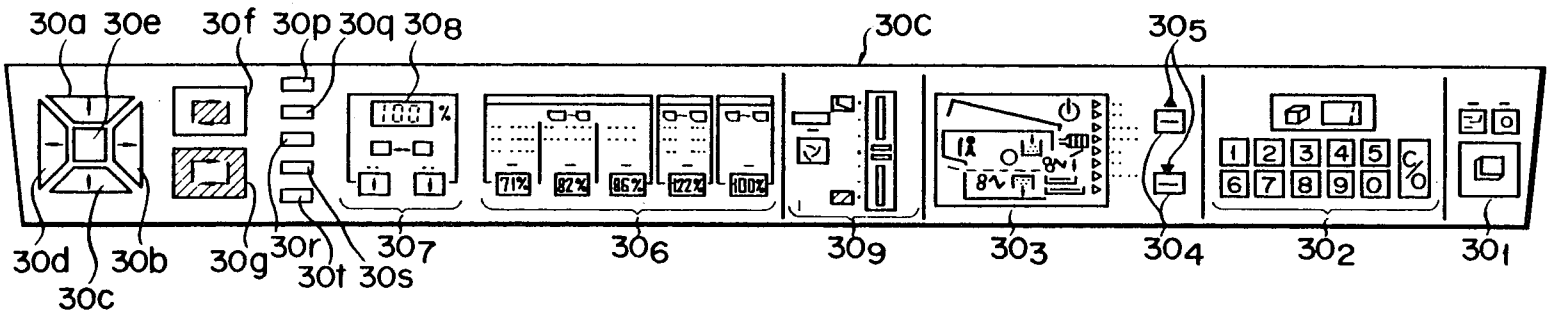

FIG. 43 shows control panel 30C used in the application. Control panel 30C has original specifying keys 30*p* and 30*q* specifying first and second originals, respectively, black key 30*r* for specifying developing unit $12_2$ containing black toner, red key 30*s* for specifying developing unit $12_1$ containing red toner, and editing key 30*t* for specifying the editing mode.

Figure 44:
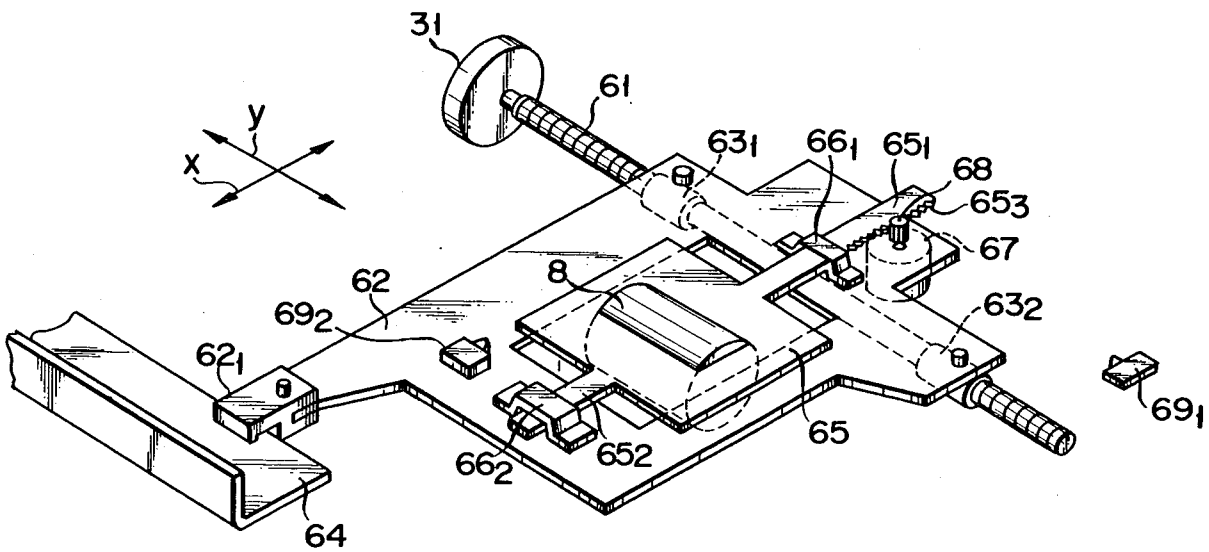

FIG. 44 shows a drive mechanism for block 8. Motor 31 drives lead screw 61 arranged along the moving direction (y direction) of carriage $41_1$. Bushings $63_1$ and $63_2$ disposed at one end of base plate 62 are meshed with screw 61. When screw 61 is rotated, plate 62 is moved along the y direction. Guide member $62_1$ is arranged at the other end of plate 62. Member $62_1$ is slidably engaged with guide rail 64. Movable member 65, upon which block 8 is mounted, is mounted on plate 62 and is movable along a direction (x direction) perpendicular to plate 62. Supports $65_1$ and $65_2$ are mounted at two ends of member 65 and are guided by guide members $66_1$ and $66_2$ mounted on plate 62. Rack $65_3$ is mounted on the side surface of support $65_1$ along its longitudinal direction. Pinion 68 is mounted on rack $65_3$ and can be rotated by pulse motor 67 mounted on plate 62. When motor 67 is driven, block 8 is moved along the x direction. It should be noted that microswitches $69_1$ and $69_2$ detect the initial positions of plate 62 and member 65, respectively.

Figure 45A:
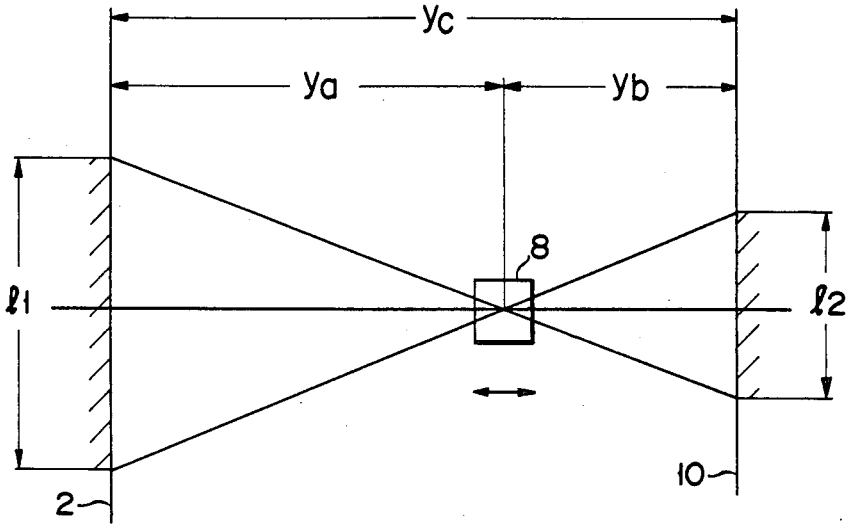
FIGS. 45A and 45B are representations for explaining the relationship between the variable lens block and the image to be formed.

The relationship between the operation of block 8 and the image to be formed will now be described. Referring to FIG. 45A, if the focal distance of block 8 is given by f, the optical path length between table 2 and block 8 is given by ya, the optical path length between block 8 and drum 10 is given by yb, and the overall optical path length between table 2 and drum 10 is given by yc, the following optical relation is derived:

$$1/f=1/ya+1/yb$$

A magnification K is thus given by:

$$K=yb/ya$$

Since focal distance f of block 8 is predetermined, it is aparent that length yc as well as length ya or yb must be changed to achieve the in-focus state in the variable magnification mode. Lengths ya and yb can be varied by moving block 8 in the y direction. Length yc can be varied by moving carriage $41_2$ and changing the positions of mirrors 6 and 7.

Figure 45B:
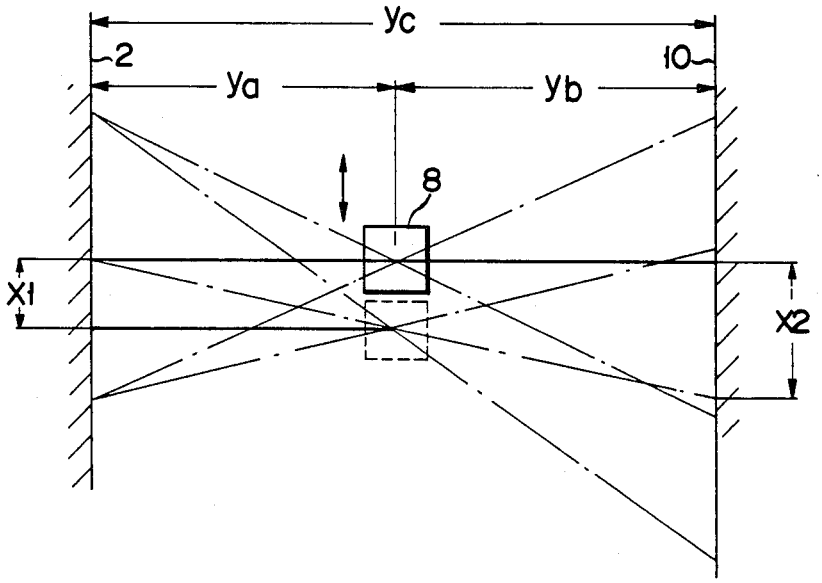

As shown in FIG. 45B, if the distances between table 2, block 8 and drum 10 are predetermined, and block 8 is moved by motor 67 by distance x1 along the x direction, an image on drum 10 can be shifted by distance x2, where x2 is given by:

$$x2=x1(yb/ya)$$

When an equal size mode is set, distance x2 is given by:

$$x2=2x1$$

In this manner, the center of the copied image can be shifted by moving block 8 along the x direction.

Figure 46:
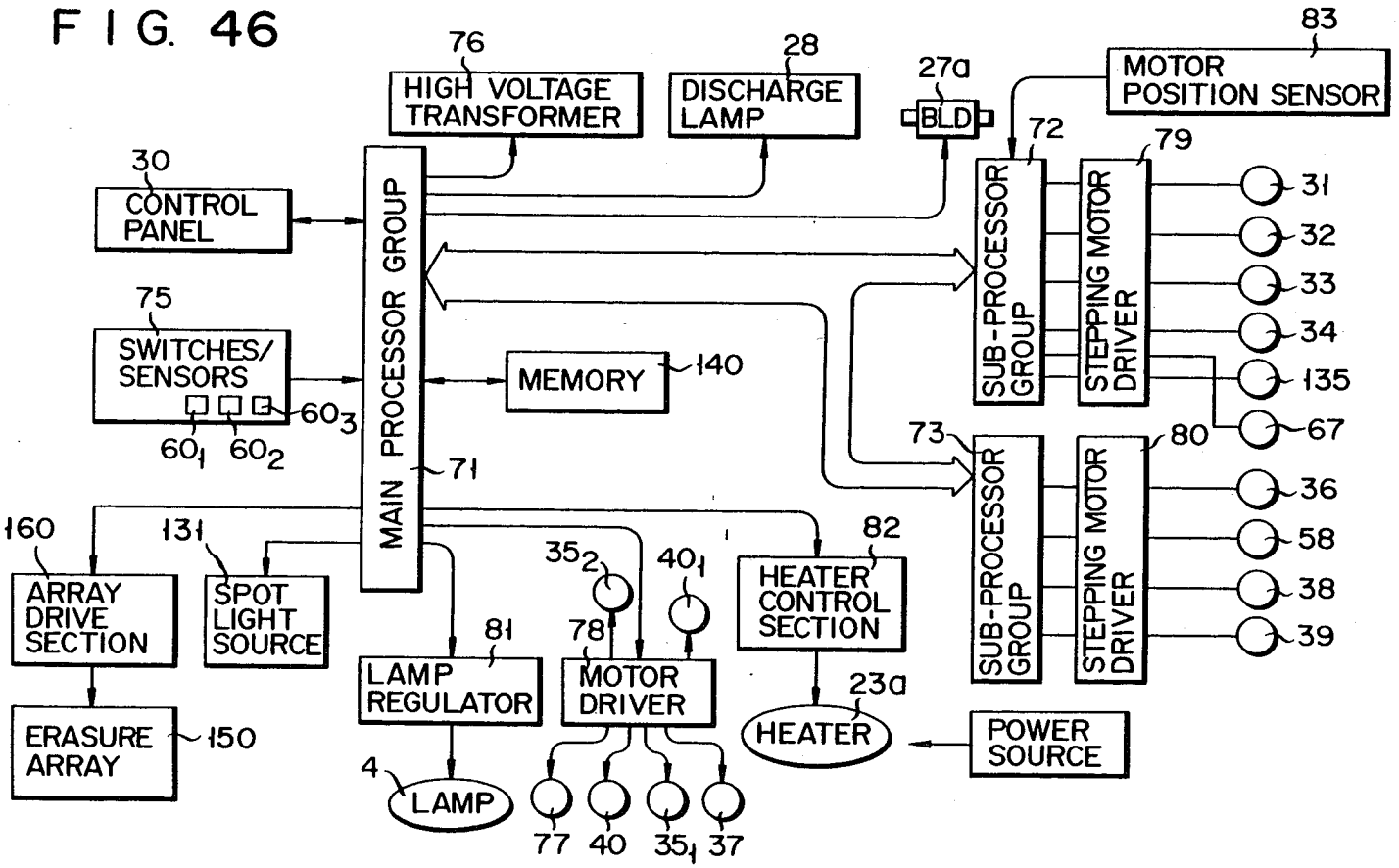

FIG. 46 shows an overall control circuit used in the application. Referring to FIG. 46, the control circuit is the same as that in the second embodiment, except that stepping motor driver 74 additionally drives stepping motor 67.

Figure 47:
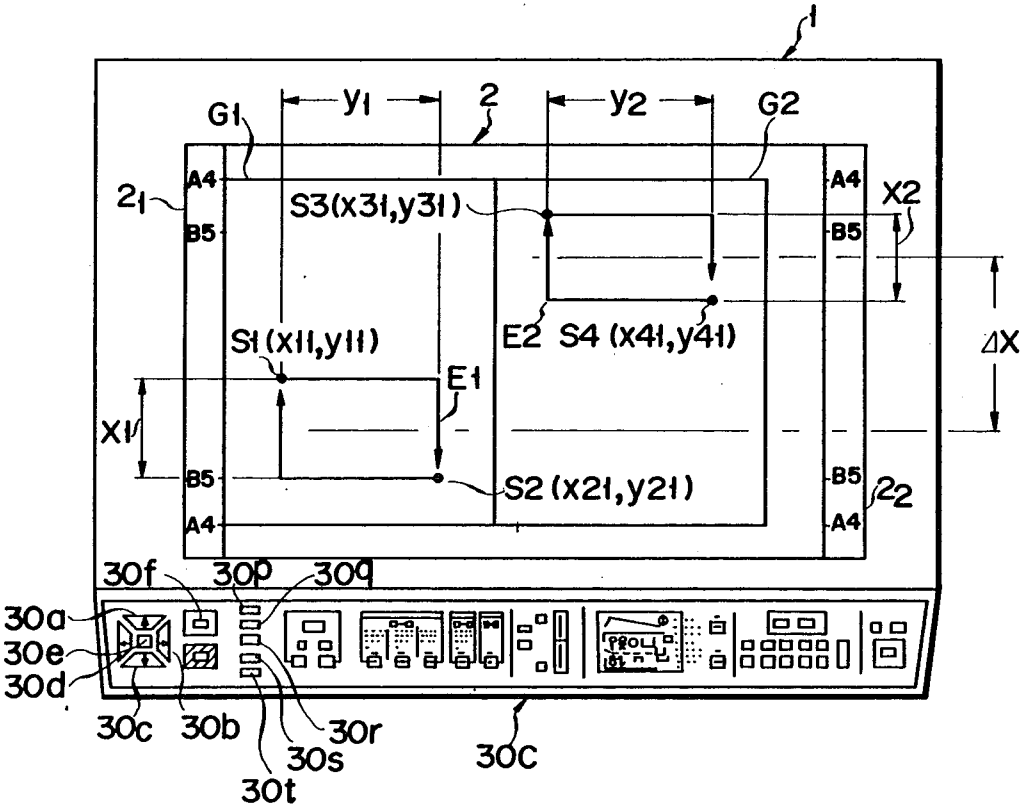

The principal portion of the application of the present invention will be described hereinafter. The copying machine exemplified by the application can edit the original image and copy an edited image. More particularly, a desired portion of an image of an original is shifted to a desired portion of another original, and a shifted image can be copied on the desired portion of the latter original with the different color. For example, as shown in FIG. 47, an image represented by area E1 and included in first original G1 set at the side of scale $2_1$ on table 2 is erased, and an image represented by area E2 and included in second original G2 set adjacent to original G1 can be enlarged or reduced and copied in the erased portion of original G1.

The editing and copying modes will be described with reference to FIG. 47. The operator depresses key 30*p* and black key 30*r* at panel 30C and moves spot light to specify area E1 of original G1 by coordinate data of light spots S1 and S2. Subsequently, the operator depresses key 30*q* and red key 30*s*, and moves spot light to specify area E2 of original G2 by coordinate data of light spots S3 and S4. In this state, when the operator depresses key 30*t*, group 71 calculates x-direction difference $\Delta x = |x11 = x31|$ between x-direction lengths of areas E1 and E2 in accordance with coordinate data of light spots S1 to S4. Difference Δx corresponds to an x displacement of block 8. Group 71 also calculates x and y lengths of areas E1 and E2 as coordinates (x1,y1) and (x2,y2) in accordance with coordinate data of spots S1 and S2 and spots S3 and S4, thereby calculating x and y magnifications Kx and Ky as follows:

$$Kx = x2/x1$$

$$Ky = y2/y1$$

When the x magnification differs from the y magnification, a smaller magnification is selected. Y difference Δy is given as $|y11 - y31|$.

When the operator depresses key $30_1$ in this state, first original G1 is first scanned, and the image portion specified by area E1 is erased, so that the remaining image portion is copied with the black toner.

Figure 48A:
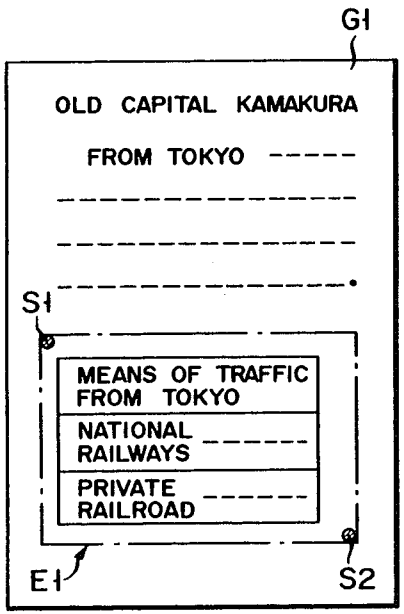
FIGS. 48A to 48E are views for explaining editing and copying.
Figure 48B:
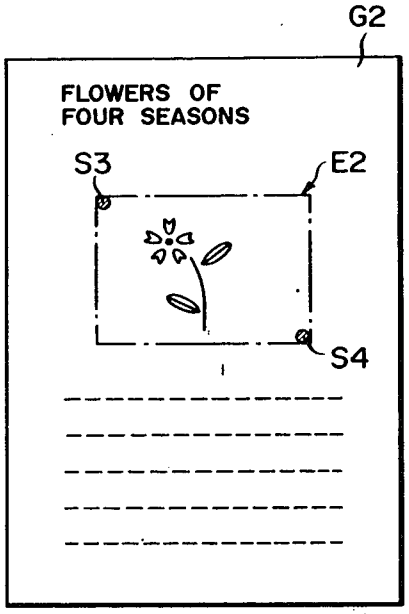
Figure 48C:
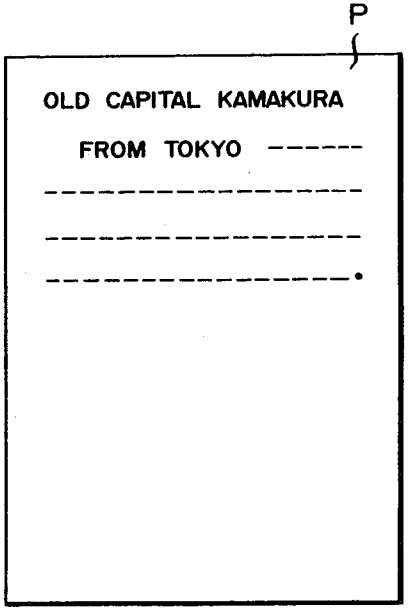
Figure 48D:
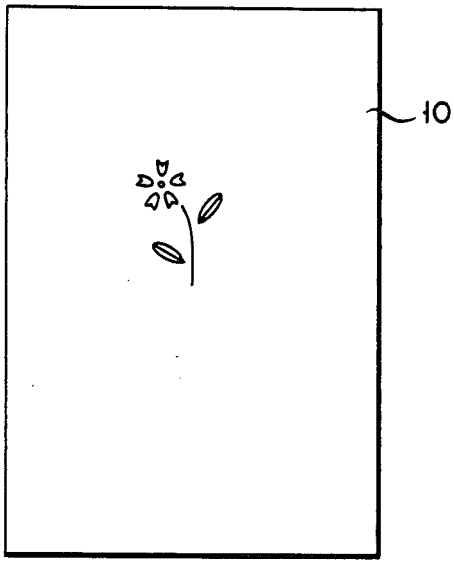
Figure 48E:
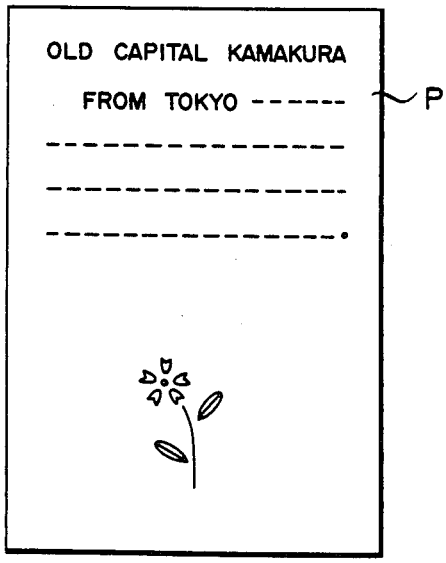

Assume that original G1 is given in FIG. 48A. By the above-mentioned copying operation, an image without a portion corresponding to area E1 of first original G1 is formed on sheet P with the black toner. Copied sheet P is fed by members 128*b*–128*i* in unit 128 again to the transfer section. Meanwhile, block 8 is shifted to a predetermined position by stepping motors 67 and 31 driven in response to difference Δx and magnification Kx or Ky. When sheep P reaches the transfer section, carriage $41_1$ is shifted from the center position of table 2 toward scale $2_2$, and second original G2 is scanned. Sheet P is fed in response to operation of carriage $41_1$ and is operated in the same manner as when key 30*g* is depressed, thereby forming an image on drum 10. If original G2 is given as shown in FIG. 48B, an image excluding the portion specified by area E2 is erased. The remaining image is enlarged or reduced in accordance with the magnification corresponding to the size of area E2, and is copied with the red toner. The image formed on drum 10 is transferred to the portion of sheet P which is specified by area E1, so that the image is formed on sheet P, as shown in FIG. 45E. Sheet P having the image thereon is discharged to tray 25 through pairs 23, 24 and $60_4$, thereby completing copying.

According to the application, the unncessary portion of the original can be specified and erased, and an edited image can be formed. At the same time, a desired portion of original G1 is erased, and a remaining portion is copied. A desired portion of original G2 is enlarged or reduced in accordance with a proper magnification and the enlarged or reduced image can be copied in the erased portion of original G1 with the different color. Therefore, the original images can be edited and copied in a variety of applications, thus providing practical advantages.

Furthermore, since the erasure position can be specified while two originals are placed on table 2, good operability can be guaranteed.

Figure 49:
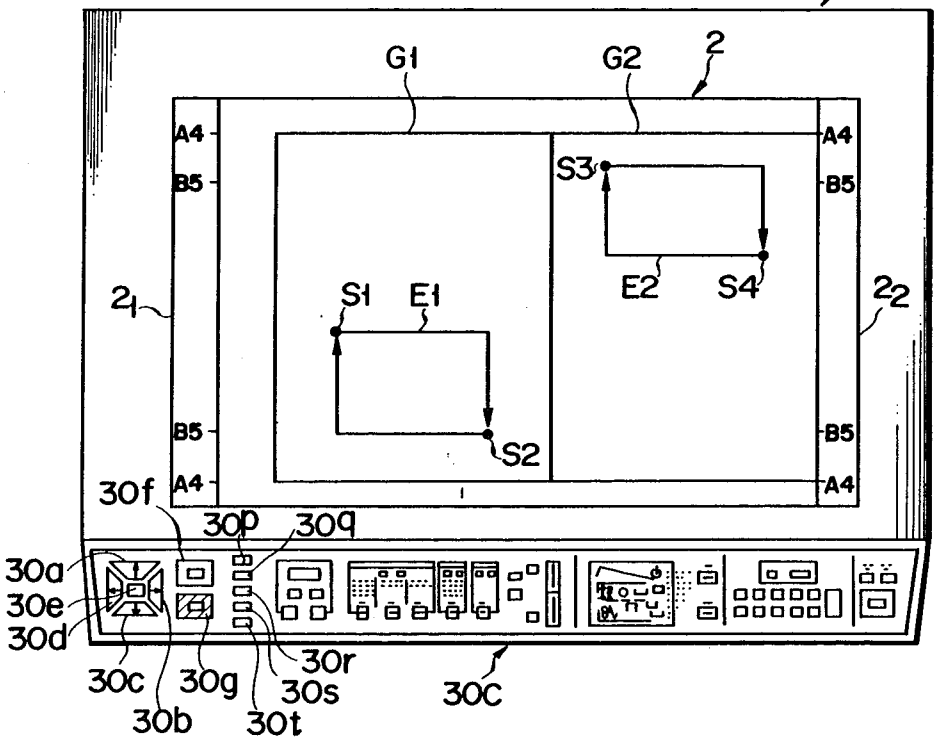
Figure 50:
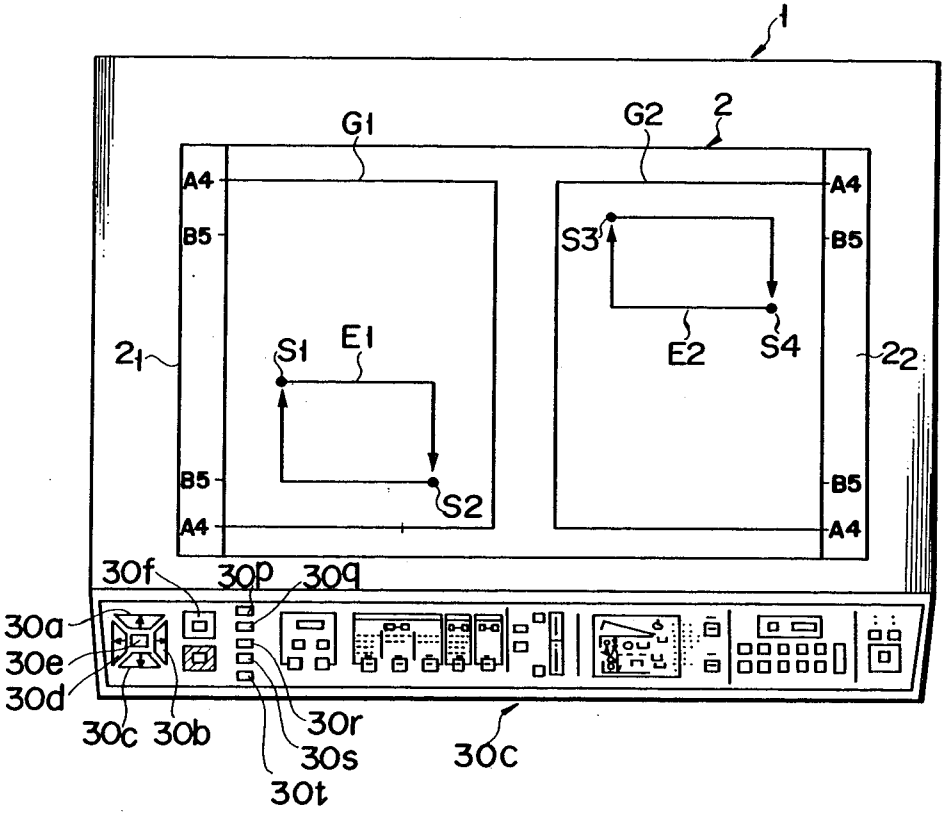

In the application, original G1 is set at scale $2_1$ and original G2 is set adjacent to original G1. However, when operating timings of carriage $41_1$ and drum 10 are changed, second original G2 can be set at scale $2_2$ and first original G1 can be set adjacent to second original G2, as shown in FIG. 49. Alternatively, as shown in FIG. 50, first and second originals G1 and G2 can be set at first and second scales $2_1$ and $2_2$, respectively.

According to the application of the present invention as described above, there is provided an image forming apparatus wherein a desired portion of the original image can be selectively erased, enlarged, reduced and/or shifted, thereby editing images of a plurality of originals and forming an editing image with a plurality of colors.

Figure 20B:
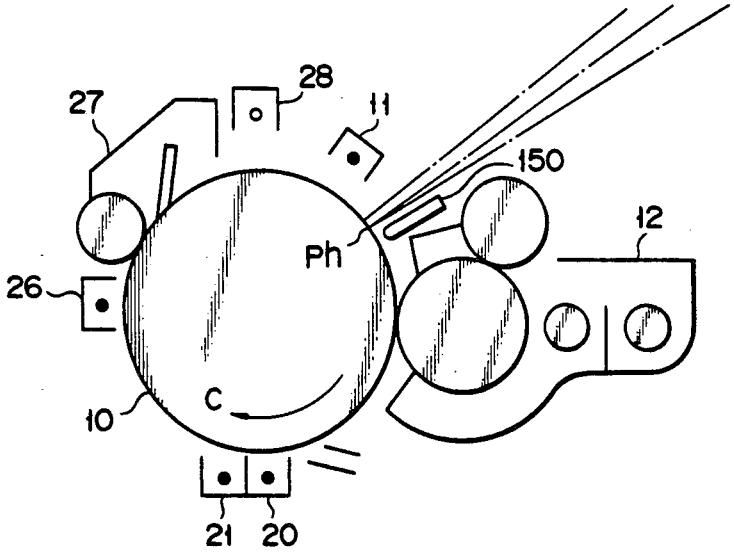
FIG. 20B is a side sectional view of the principal part showing another arrangement of the erasure array.

In each embodiment and application described above, array 150 need not be arranged between charger 11 and exposure portion Ph, as shown in FIG. 20A. However, as shown in FIG. 20B, array 150 may be arranged between portion Ph and unit 12, and the latent image can be erased as needed.

Another application of the present invention will be described below.

Figure 51A:
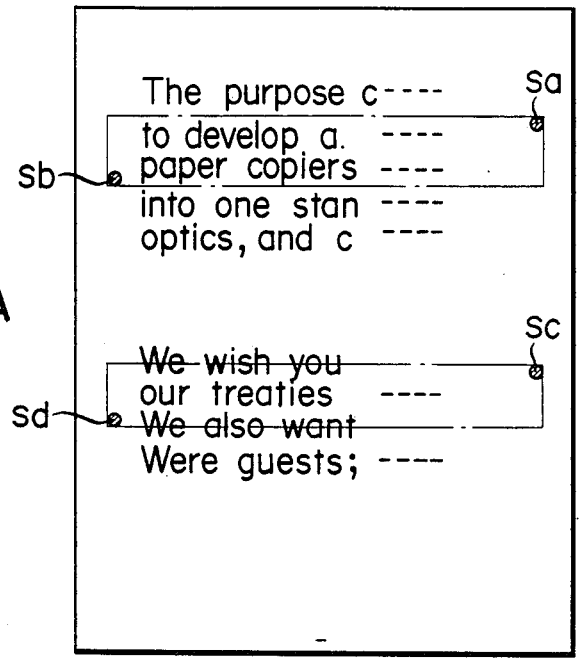

The vertical spacing in a normal typewriter is typically 1/6 of an inch and sometimes $\frac{1}{4}$ or $\frac{1}{3}$ of an inch. If the arrangement pitch of elements 152 of array 150 does not correspond to a typewriter's vertical spacing, an image in the range defined by Sa and Sb can be erased, but an image in the range defined by Sc and Sd may overlap a sentence portion and thus not be erased, as shown in FIG. 51A.

Figure 51B:
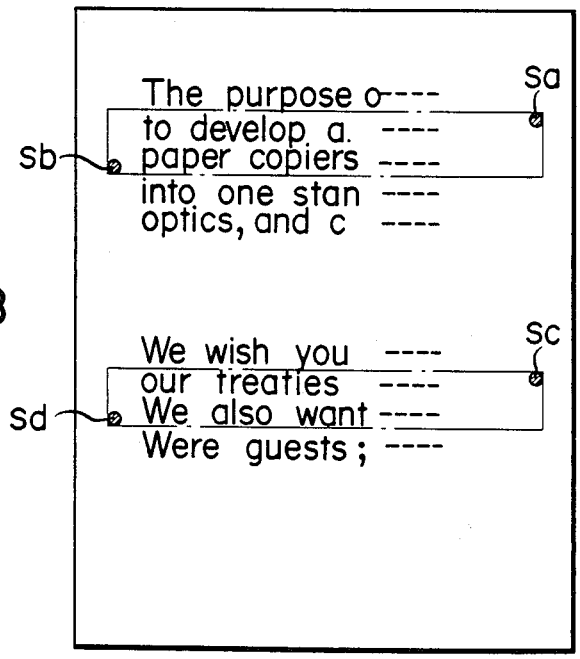

When pitch P of elements 152 of array 150 is set to be, e.g., 1/12 of an inch, a given image portion can be completely erased irrespective of the specified range, as shown in FIG. 51B.

With this pitch P, even if the line pitch of an original is $\frac{1}{4}$ or $\frac{1}{3}$ of an inch, since the former is an integer multiple of the latter two, complete erasure can be performed.

In the above example, pitch P of elements 152 of array 150 is set to be 1/12 of an inch. Therefore, an erasure portion will not overlap a sentence portion and can be completely erased irrespective of the vertical spacing of the original image.

When the arrangement pitch of the light-emitting elements is selected in this manner, erasure can be properly performed irrespective of vertical spacing of originals and only a minimum number of light-emitting elements need be used.

In the above example, pitch P of elements 152 is selected to be 1/12 of an inch. However, the present invention is not limited to this, and pitch P can be 1/24 of an inch.

Various other changes and modifications of the present invention can be made within the spirit and scope of the present invention.

What is claimed is:

1. An image forming apparatus with an image adding function, said apparatus comprising:

an original table on which an original is placed, the original being capable of transmitting light therethrough;

light-transmitting means for emitting the light onto the original placed on said original table while the light is moved therealong;

additional image formation specifying means for specifying a desired additional image formation, an additional image formed by the additional image formation being comprised of pixel elements having a variable width and length which are determined at a desired portion of the original on said original table when the light emitted from said light-transmitting means moves;

image forming color specifying means for specifying at least a preselected first image forming color other than black and a second image forming color of black in correspondence with formation of first and second images;

first controlling means for calculating positional data of an image area outside the desired additional image formation specified by said additional image formation specifying means, based on movement of the light emitted by said light-transmitting means, and for storing the calculated positional data;

second controlling means for receiving and storing data of the first and second image forming colors which are specified by said image forming color specifying means in correspondence with formation of the first and second images;

original scanning means, movable along said original table, for optically scanning the original placed on said original table and for forming a reflected light image thereof;

image forming means for focusing the reflected light image obtained by said original scanning means, developing the image, and forming a corresponding image on an image forming medium by selectively driving a plurality of developing units of different colors;

image forming medium feed-back means for selectively feeding back said image forming medium on which an image is formed by said image forming means;

image erasing means for selectively erasing the image formed by said image forming means;

third controlling means for enabling said image erasing means and said image forming means, and disabling said image forming medium feed-back means and said original scanning means during formation of the first image;

fourth controlling means, operable during formation of the second image, for reading out positional data of an image portion outside the desired additional image formation from said first controlling means and the data of the first image forming color from said second controlling means, and for supplying the readout data to said image erasing means, thereby allowing said image forming means to form a desired additional image in a corresponding portion on said image forming medium;

fifth controlling means for disabling said image erasing means and enabling said image forming medium feedback means, said original scanning means, and said image forming means during formation of the second image; and sixth controlling means, operable during formation of the second image, for reading out the data of the second image forming color from said second controlling means and for supplying the readout data to said image forming means, thereby allowing said image forming means to form the image of the original in the second image of the original in the second image forming color on the image forming medium, which has been fed back.

2. An apparatus according to claim 1, wherein said light-transmitting means is movable with respect to said original scanning means in a direction perpendicular to a moving direction of said original scanning means, and includes a light-emitting element and a lens for providing spot light.

3. An apparatus according to claim 1, wherein said image erasing means includes a plurality of light-emitting elements which are opposed to said image forming means and which are arranged in rows.

4. An apparatus according to claim 3, wherein said plurality of light-emitting elements are arranged at positions so as to selectively radiate said image forming means in an image forming step thereof.

5. An apparatus according to claim 3, wherein said plurality of light-emitting elements are arranged at positions so as to selectively radiate said image forming means in an image developing step thereof.

6. An apparatus according to claim 1, wherein said additional image formation specifying means includes underline formation specifying means.

7. An apparatus according to claim 1, wherein said additional image formation specifying means includes solid image range specifying means.

8. An apparatus according to claim 7, wherein said solid image range specifying means can specify a bar-graph-like solid image range.

9. An apparatus according to claim 1, wherein said additional image formation specifying means includes solid image formation specifying means.

10. An apparatus according to claim 1, wherein said additional image formation specifying means includes bar graph-like solid image formation specifying means.

11. An apparatus according to claim 1, wherein said additional image formation specifying means includes character image formation specifying means.

12. An apparatus according to claim 1, wherein said additional image formation specifying means includes symbol image formation specifying means.

* * * * *